US005720225A

United States Patent [19]

Pugin

[11] Patent Number: 5,720,225

[45] Date of Patent: Feb. 24, 1998

[54] ELEVATED CABLEWAY SYSTEM

[75] Inventor: André Oscar Pugin, Corseaux, Switzerland

[73] Assignee: Aerobus International, Inc., Houston, Tex.

[21] Appl. No.: 510,479

[22] Filed: Aug. 2, 1995

[51] Int. Cl.[6] ..... E01B 25/00

[52] U.S. Cl. ..... 104/123; 104/125

[58] Field of Search ..... 104/123, 124, 104/125, 112; 14/8, 11, 18, 19, 20, 21, 26, 22, 23

[56] References Cited

U.S. PATENT DOCUMENTS

| | | | |
|---|---|---|---|
| 3,055,484 | 9/1962 | Hubert | 14/18 |
| 3,091,190 | 5/1963 | Cruciani | 104/115 |
| 3,092,326 | 6/1963 | Hohla | 238/119 |
| 3,464,365 | 9/1969 | Bertin | 104/125 |
| 3,541,964 | 11/1970 | Harbert | 104/123 |
| 3,550,536 | 12/1970 | Lesh | 104/124 |
| 3,590,743 | 7/1971 | Larson | 104/130 |
| 3,604,361 | 9/1971 | Harbert | 104/123 |
| 3,690,266 | 9/1972 | Mayo | 104/123 |
| 3,753,406 | 8/1973 | Muller | 104/123 |
| 3,903,807 | 9/1975 | Lee | 104/131 |
| 3,985,081 | 10/1976 | Sullivan, II | 104/23 |
| 4,002,125 | 1/1977 | Spoler | 104/124 |
| 4,021,875 | 5/1977 | Abell et al. | 14/10 |
| 4,069,765 | 1/1978 | Muller | 14/18 |
| 4,163,498 | 8/1979 | Grooss et al. | 414/697 |
| 4,208,969 | 6/1980 | Baltensperger et al. | 104/111 |
| 4,264,996 | 5/1981 | Baltensperger et al. | 104/125 |
| 4,462,314 | 7/1984 | Kunczynski | 104/115 |
| 4,641,587 | 2/1987 | Dalliard | 105/3 |
| 4,665,830 | 5/1987 | Anderson et al. | 104/124 |
| 4,953,468 | 9/1990 | Creissels | 104/123 |
| 5,231,931 | 8/1993 | Sauvageot | 104/124 |

FOREIGN PATENT DOCUMENTS

| | | | |
|---|---|---|---|
| 561095 | 9/1993 | European Pat. Off. | 104/123 |
| 3505470 | 10/1986 | Germany | 14/18 |
| 164671 | 6/1989 | Japan | 104/123 |
| 626016 | 2/1994 | Japan | 14/22 |
| 402599 | 10/1973 | Russian Federation | 14/22 |
| 588372 | 5/1977 | Switzerland . | |
| 592206 | 10/1977 | Switzerland . | |

OTHER PUBLICATIONS

Suspended Light Rail System Technology Pilot Project, vol. 1 Proposal, Milwaukee County, Aerobus of Texas, Inc., 150 pages, (Sep. 29, 1993).

Suspended Light Rail System Technology Pilot Project, vol. 2: References, Milwaukee County, Aerobus of Texas, Inc., 238 pages, (Sep. 29, 1993).

Assessment Of The Mueller Aerobus System, The System Installed and Operated for the Bundesgartenschau 1975, Mannheim, Germany, U.S. Department of Transportation Urban Mass Transportation Administration, Washington, D. C., Final Report, 258 pages, (Sep. 1979).

Aerobus By Parks, A Railroad In The Sky, Fred Parks, 4 pages, (no date).

Aerobus Vehicle Simulation, Videotape, Fred Parks, 1995.

Aerobus, Videotape, Fred Parks, 1988.

Aerobus Route Simulation, Videotape, Fred Parks, 1995.

*Primary Examiner*—Mark T. Le

*Attorney, Agent, or Firm*—Vaden, Eickenroht & Thompson, L.L.P.

[57] ABSTRACT

An improved cableway system includes a base pylon; a lower saddle mounted to the base pylon from which a track cable may be strung; and an upper saddle from which a catenary cable may be strung, the upper saddle movably mounted to the base pylon to articulate in response to the weight of a vehicle traversing the track cable. The lower saddle is a linkage pivotally mounted to the base pylon beneath the first saddle to accommodate the articulation of the upright and distribute the weight of the vehicle across a portion of the track cable. The hanger for suspending a track cable from a catenary cable includes a hanger member suspended from the catenary cable by one end thereof; a cross-tie pivotably mounted to the hanger member at the end distal to the catenary cable; a track cable guide affixed to the cross-tie; and a power rail guide mounted to one of the suspended member and the cross-tie. A new equalizing lock is also provided to provide improved lateral support for the union of the catenary and track cables.

6 Claims, 17 Drawing Sheets

ELEVATED CABLEWAY SYSTEM

BACKGROUND OF THE INVENTION

1. Field of the Invention

This invention pertains to elevated cableway systems used in mass transit systems and the like, and, more particularly, to an improved cableway for such systems.

2. Description of the Prior Art

Many types of elevated cableway systems have been used in or proposed for mass transit systems. One such system is disclosed and claimed in U.S. Pat. No. 4,069,765 issued Jan. 24, 1978 to Gerhard Müller. This system is neither a suspension, or cable stayed, bridge nor an aerial tramway. Consequently, not all standard design criteria are necessarily applicable to the system in the Müller '765 patent.

The Müller '765 patent discloses this non-standard approach and FIGS. 1–5 of the present application correspond to FIGS. 3–7 of the Müller '765 patent. FIG. 1 illustrates in gross an elevated cableway system 10 in which vehicle 12 travels along track cable 14 suspended from catenary, or support, cable 16. As shown in FIGS. 2–3 and 5, track cable 14 comprises locked-coil steel cables **14*a–d* and catenary cable 16 comprises locked-coil steel cables 16*a–b*. Returning to FIG. 1, a plurality of pylons 18 elevate and support track cable 14 and catenary cable 16 between the termini 20 of system 10. Track cable 14 and catenary cable 16 are preferably anchored to ground 19 to sustain horizontal cable forces and transmit them to ground 19**.

One of Müller's basic approaches is illustrated in FIGS. 1–2. Stress loads associated with the "sag" in track cable 14 and catenary cable 16 caused by the weight of vehicle 12 were a problem for cableway systems at the time Müller filed the '765 patent application as shown in FIG. 1. M üller proposed, as disclosed in the '765 patent, to address these problems by pre-tensioning, or pre-stressing, track cable 14 as shown in FIG. 2 so that track cable 14 levelled under the weight of vehicle 12 as shown in FIG. 1.

Part of Müller's proposed design included new cross-ties 26 and hangers, or spacers, 28 for suspending track cables 14 from catenary cable 16. These cross-ties 26 and hangers 28, which were new at the time, are illustrated in FIGS. 2–3. Through this suspension system, track cables 14 were tensioned as described above and, consequently, "bowed" upward when not weighted by vehicle 12. This approach has worked well and is incorporated in the present invention as set forth below.

Müller also proposed tying track cable 14 and catenary cable 16 together between pylons 18 at points 22 as shown in FIG. 4. Müller tied the cables with force equalization plate 24, in cooperation with clamping plate 26 and wedges 28. Force equalization plate 24 also improved the distribution of load stresses in the cableway system and, in combination with tensioning track cable 14, substantially advanced the art.

Müller also adopted the pylon structure earlier disclosed in U.S. Pat. No. 3,753,406. As set forth in column 1, line 65 to column 2, line 3 of the '765 patent, it was thought the pylons in such a system must be "stiff". It was though that "self-aligning" or "self-adjusting" pylons would introduce undesirable longitudinal shifting between the catenary and track cables. However, we now know that "self-aligning" or "self-adjusting" pylons produce substantial design benefits provided measures are taken to minimize or eliminate longitudinal shifting.

Some problems also appeared in implementing Müller's design despite its great advance over the art. For instance:

(1) catenary cable 16 was strung over rollers on the top of pylons 18 and began to wear from the movement across the rollers as vehicle 12 traversed the cableway;

(2) the design of the equalizer plate 24 could also cause problems by kinking cable elements **16*a–b*, and 14*a–d*, under some circumstances; and (3) cable elements 14*a–d*** were required to have upper surfaces engageable by the wheels of the vehicle because the equalizer plate did not provide for such engagement.

It further came to be realized that load stresses could be better distributed through redesign of the force equalizer plate as well as the hangers and cross-ties, particularly in light of the new pylon designs.

It is therefore a feature of this invention that it provides an improved pylon design for elevated cableway systems.

It is furthermore a feature of this invention that the improved pylon design reduces wear on the catenary cable by replacing rollers on the top of the pylon.

It is furthermore a feature of this invention that the improved pylon includes a new, articulating upper saddle.

It is a still further feature of this invention that the improved pylon includes an improved, pivotable lower saddle.

It is also a feature of this invention that the improved lower saddle better transmits forces and distributes load stresses through the cableway system as the vehicle traverses the cableway.

It is furthermore a feature of this invention that load stresses are distributed through improved hanger and spacer designs.

It is still furthermore a feature of this invention that it provides an improved cableway system with greater lateral support for the union between the catenary and track cables having an improved equalizer lock.

SUMMARY OF THE INVENTION

The invention is an improved cableway system. The improved system includes a pylon comprising a base pylon; a lower saddle mounted to the base pylon from which a track cable may be strung; and an upper saddle from which a catenary cable may be strung, the upper saddle movably mounted to the base pylon to articulate in response to the weight of a vehicle traversing the track cable.

The improved pylon also includes in some embodiments a new lower saddle including a main beam pivotally mounted at the center of its longitudinal axis to the pylon for rotation in a first vertical plane; a pair of secondary beams each pivotally mounted at the center of its longitudinal axis to the main beam substantially at a respective end of the main beam for rotation in the first vertical plane; four tertiary beams each pivotally mounted at the center of its longitudinal axis to one of the respective secondary beams substantially at a respective end of the one secondary beam for rotation in the first vertical plane; eight suspension rods each pivotally mounted at one of its ends to one of the respective tertiary beams substantially at a respective end of the one tertiary beam for rotation in the first vertical plane, the other end of each suspension rod being pivotally connected to a cross-tie at the center of the cross-tie's longitudinal axis for rotation of the cross-tie in a second vertical plane that is perpendicular to the first vertical plane, the cross-tie supporting the second cable.

The improved cableway system also includes improved hangers and cross-ties comprising a hanger member suspended from the catenary cable by one end thereof; a cross-tie pivotably mounted to the hanger member at the end distal to the catenary cable; a track cable guide affixed to the cross-tie; and a power rail guide mounted to the cross-tie.

An assembly for joining the support cable to the track cables midway between the pylons is also disclosed to equalize the tension between the support and track cables, the assembly comprising a force equalization plate having at least three parallel channels formed along the length of a surface thereof for accepting the support cable in the center channel and the track cables in the outer channels, the channels being shaped to approximate one-half of the respective cable circumferences except that the ends of the channels are flared outwardly; and a clamping plate having at least three parallel channels formed along the length of a first surface thereof for accepting the support cable in the center channel and the track cables in the outer channels, the channels being shaped to approximate one-half of the respective cable circumferences except that the ends of the channels are flared outwardly, said channeled clamping plate having a second surface opposite the first surface that is adapted for engagement by the wheels of the cable car; the channeled surfaces of said force equalization plate and said clamping plate being complementary such that the plates may be assembled about the cables for frictionally locking the cables within the respective channels to equalize the tension in the support and track cables, the respective flared ends of the channels in the assembled plates forming a frusto-conical cavity in each end of the assembly about each of the cables for reducing wear on the cables by the ends of the plates.

BRIEF DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only preferred embodiments of the invention and are not to be considered limiting of its scope as the invention will admit to other equally effective embodiments. In the drawings:

FIG. 7A is a side, elevational view; FIG. 7B is a broken orthogonal perspective view; FIGS. 7C–D are elevational and plan views, respectively, of the base of the upper saddle in partial section;

FIG. 7M is a partial elevational view; FIG. 7N is a side elevational view taken along section 7N—7N in FIG. 7M; FIG. 7P is a plan view of FIG. 7M.

FIG. 7R is an elevational view; FIG. 7S is a side elevational view taken along section 7S—7S in FIG. 7R; FIG. 7T is a side elevational view taken along section 7T—7T in FIG. 7R; FIG. 7U is a plan view taken along section 7U—7U in FIG. 7R;

FIG. 7V is an elevational view; FIG. 7W is a plan view of FIG. 7V; FIG. 7X is a side elevational view taken along section 7X—7X in FIG. 7W;

FIG. 8A in partially exploded perspective and FIG. 8B in elevation;

FIG. 10A in a top view with ghosted lines, FIG. 10B in section along line 10B—10B in FIG. 10A and in partial cutaway, and FIG. 10C in a front view.

DESCRIPTION OF THE PREFERRED EMBODIMENT

Figure 6:
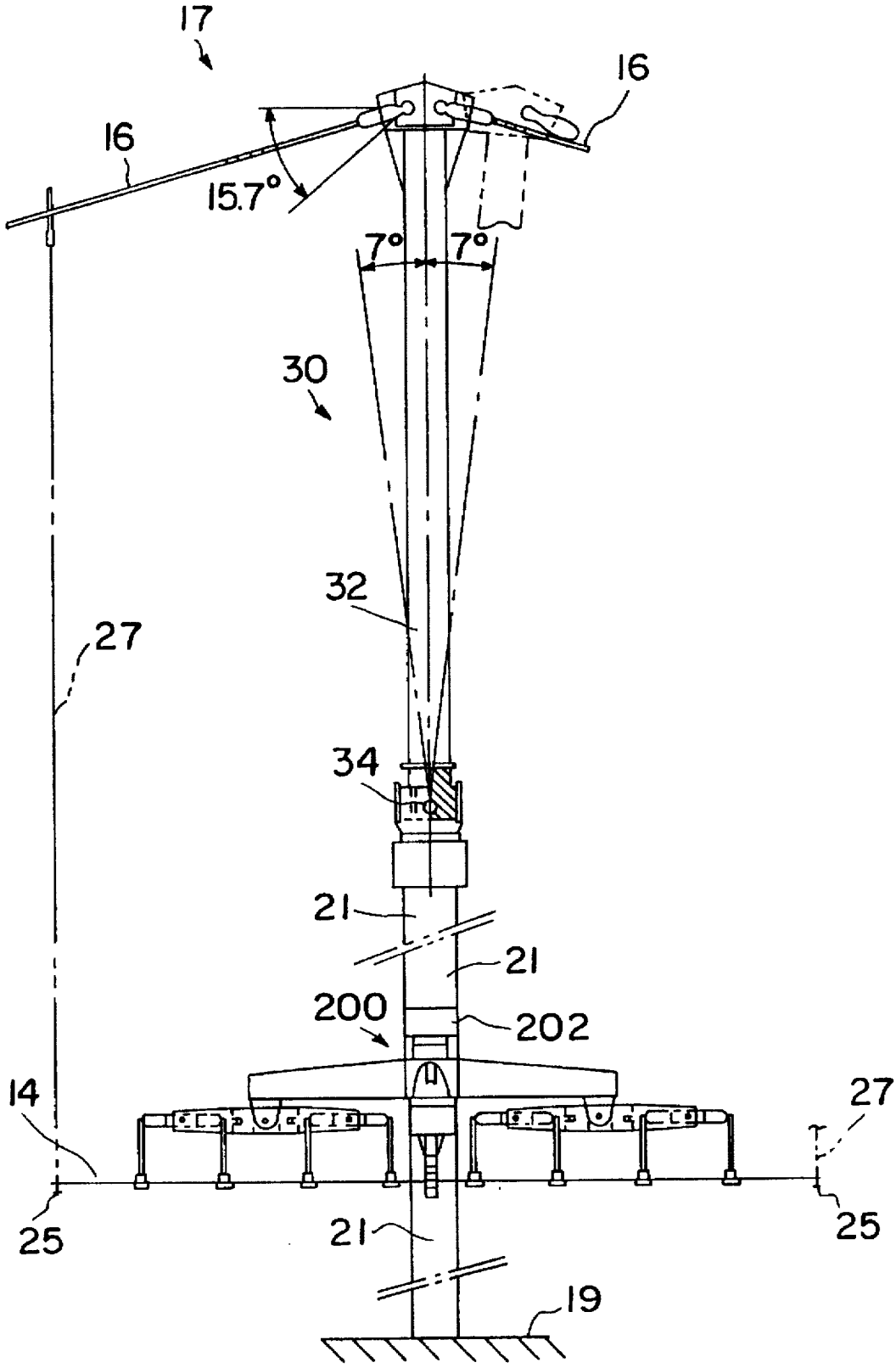
FIG. 6 illustrates the pylon of the inventive cableway system described herein, including the upper saddle and lower saddle, in elevation.

FIGS. 6 illustrates one of new pylons 17 in the preferred embodiment, including upper saddle 30 from which catenary cable 16 is strung, lower saddle 200 from which track cable 14 is strung, and base pylon 21 on which lower saddle 200 is mounted. Hangers 27 suspend track cable 14 from catenary cable 16 and pre-tension track cable 14, as described above. Pylon 17 is sunk into ground 19 by any suitable technique known to the art. The precise dimensions of pylon 17 such as height and width will be matters of engineering design predicated on well known structural principles to account for structural loads, such as vehicle and cable weight, and for loads arising from environmental conditions such as precipitation and temperature.

Figure 7A:
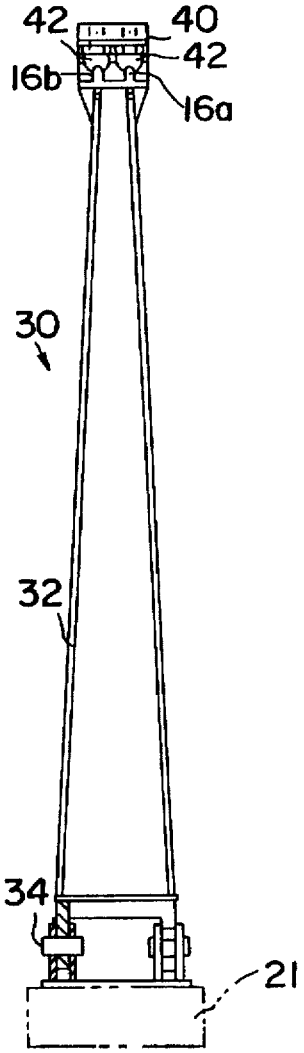
FIGS. 7A–G illustrate the upper saddle of the new pylon.
Figure 7E:
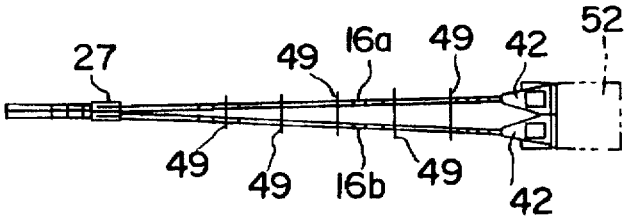
Figure 7F:
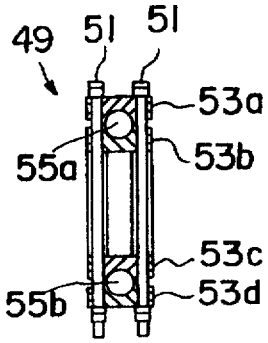
Figure 7G:
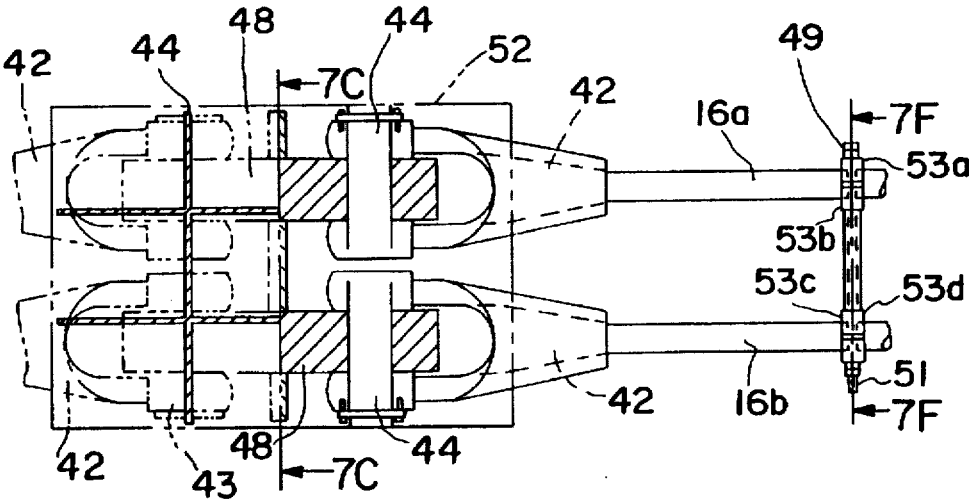
Figure 7B:
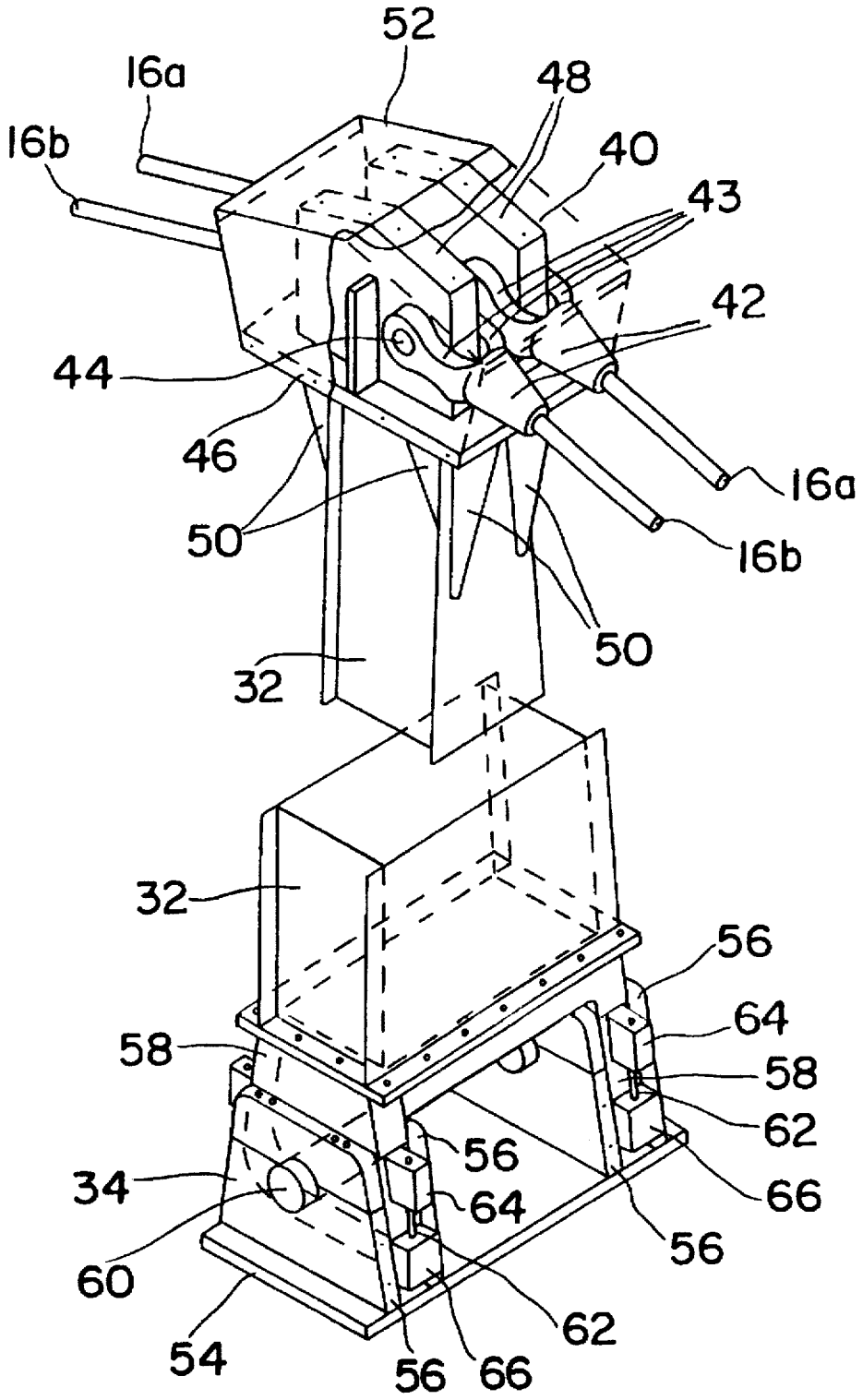
Figure 7C:
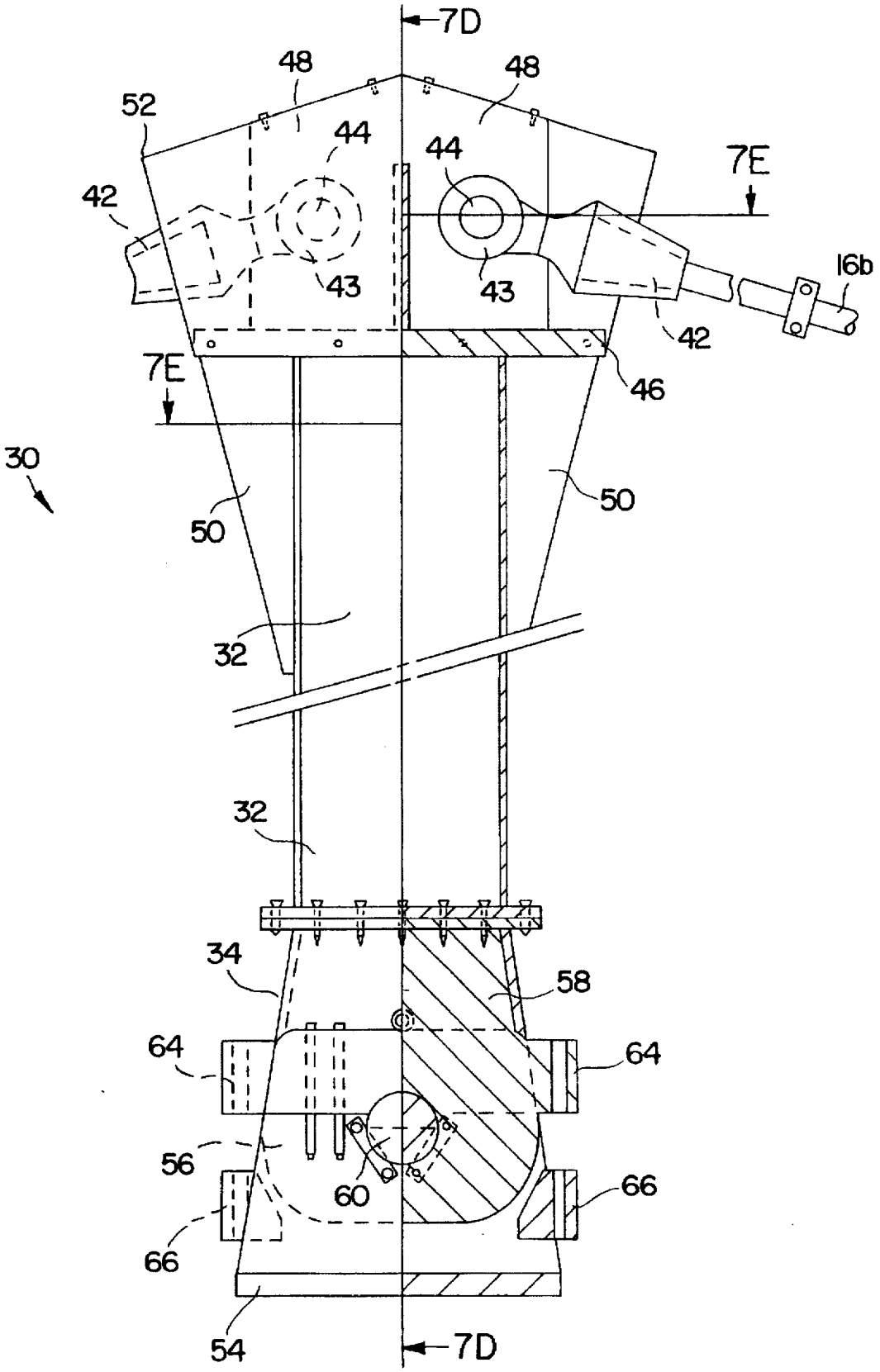
Figure 7D:
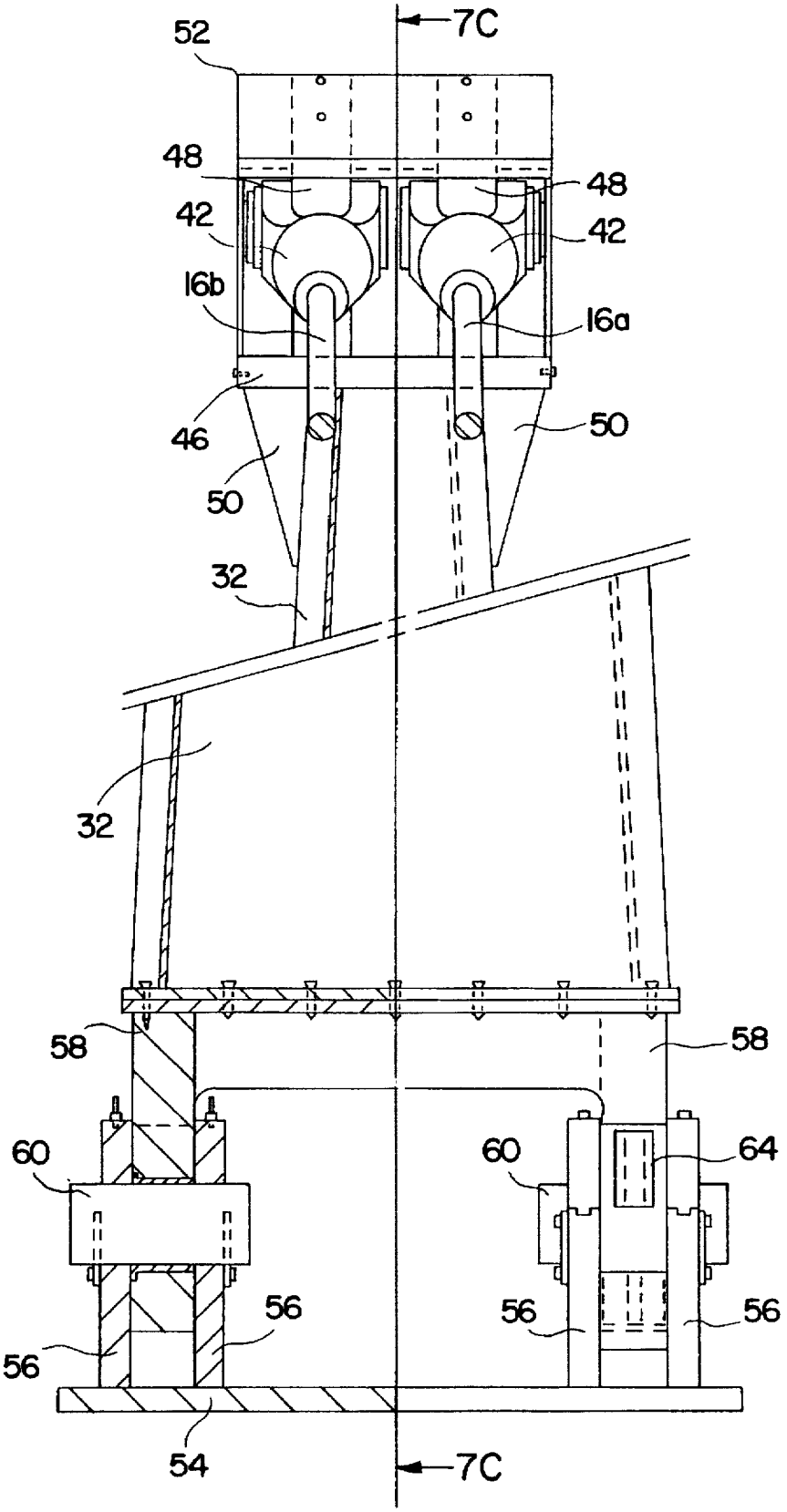

Upper saddle 30, shown in greater detail in FIGS. 7A–C, ensures free motion on top pylon 17 and transmits vertical loads from vehicle 12 and pre-tensioning forces to pylon 17. Upper saddle 30 in FIGS. 7A–C lessens fatigue on catenary cable 16, requires only limited maintenance, and eases implementation of 3° deviation of pylon 17. Upper saddle 30, as shown in FIGS. 7A and 7C, has a maximum vertical dimension being substantially larger than a maximum horizontal dimension. Upper saddle 30 comprises upright 32 pivotably mounted to base 34 and capped coupling 40, which is engaged with cable connector 42. The socket and pin connection must be strong enough to sustain the load on catenary cable 16 and lateral loads from wind.

Turning now to FIG. 7B, coupling 40, cable connector 42, and pin 44 atop upper saddle 30 are shown in an enlarged, partially cutaway view. Supports 50 help bear and distribute the load on coupling 40 to upright 32. Cover 52 provides some protection for coupling 40 and connector 42 from the elements. The socketing and pinned connection of coupling 40 engaged with cable connector 42 reduces the risk of fatigue to catenary cable 16 caused by the shifting of catenary cable 16 across pylon 18 of the system in the M üller '765 patent. The embodiment of FIGS. 7A–C thereby reduces the risk of fatigue to catenary cable 16 by precluding bending fatigue, thus leaving only tension-tension fatigue on catenary cable 16. This connection also permits shorter cable lengths to facilitate transportation, handling and construction of the system.

Coupling 40 in the preferred embodiment is a welded plate assembly including base plate 46 and at least two member plates 48 extending substantially perpendicularly from base plate 46 as shown in FIG. 7B. Cable connector 42 is socketed on one end to engage coupling 40. Pin 44 joins cable connector 42 to coupling 40 through co-aligned holes in tines 43 of forked connector 42 and coupling 40 when cable connector 42 and coupling 40 are engaged. Cables 16*a–b* in a first direction are strung from the non-connected end of cable connector 42. Coupling 40 is also joined to a second cable connector 42 that provides cable connection to cables 16*a–b* in a second direction, as shown in FIG. 7B.

Cables 16*a–b* are preferably clamped together as shown in FIG. 7E at predetermined intervals using clamps 49 between cable connector 42 and the first one of hangers 27. Clamps 49 are better illustrated in FIGS. 7F–G and comprise pins 51 joining clamp members 53*a–d*. Clamp members 53*a–d* define passages 55*a–b* through which cable members 16*a–b* pass.

Figure 10A:
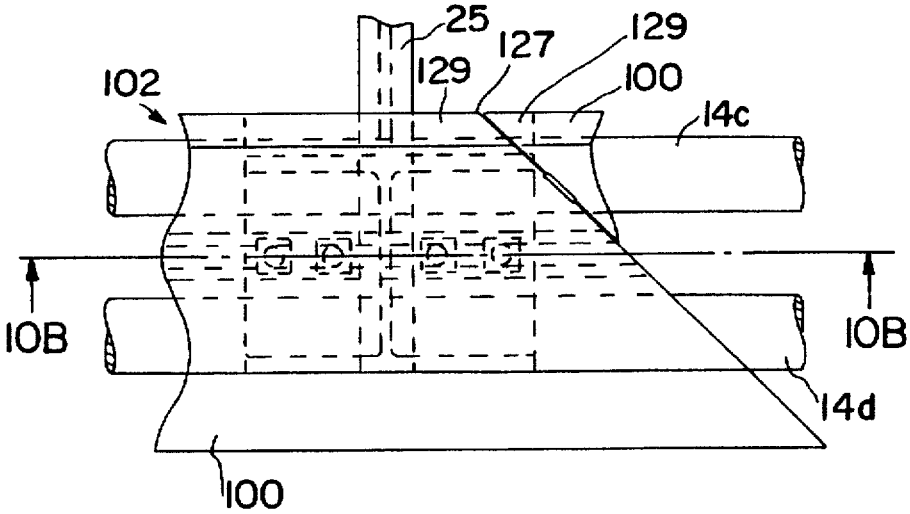
FIGS. 10A–C illustrate the cross-ties, cables, and rails of the track cable in the new system.
Figure 10B:
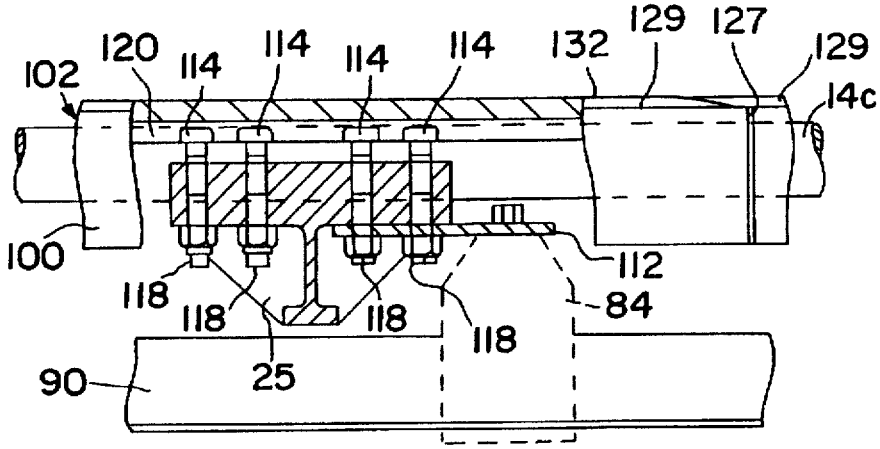
Figure 10C:
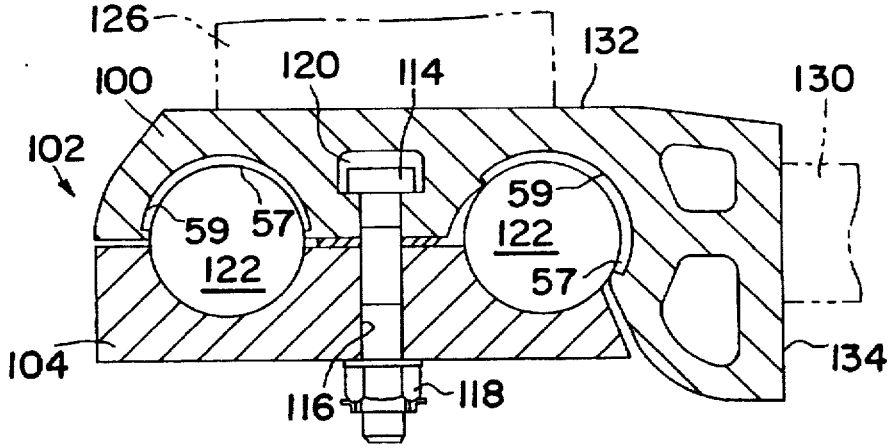

Passages 55*a–b* may include trumpeted openings on one or both ends thereof as are discussed in connection with catenary cable clamp 85 and equalizing lock 300. The trumpeted openings of passages 55*a–b* are best shown in FIG. 10C, wherein the lesser diameter at point 57 of passages 55*a–b* forms the throat of the opening and the greater diameter at point 59 forms the flare. These trumpeted openings minimize the "beam effect" wherein a clamped cable behaves structurally as a beam.

Still referring to the FIG. 7B, upright 32 is pivotably mounted to double V-shaped base 34. Base 34, like coupling 40, in the preferred embodiment is a welded plate assembly and comprises bottom plate 54 and side plates 56. Side plates 56 are attached in slotted channels at each end of bottom plate 54, as shown in FIG. 7C to define slots into which tongues 58 extend from the bottom of upright 32. Pins 60, preferably constructed from brass to reduce friction, run through co-aligned holes in side plates 56 and tongues 58. Upright 32 supports forces received through coupling 40 and transmits them to pins 60 about which upright 32 rotates.

Base 34 also includes additional means for bearing the load of upright 32. Each of these means includes a bearing pin 62 extending through a split flanged sleeve 64 and 66. Flanged sleeves 64 extend from tongues 58, and flanged sleeves 66 are welded to the interior surfaces of paired side plates 56. Bearing pin 62 is held in place by threaded nuts about pin 62 both above and below sleeve 64, and reciprocates in sleeve 66. The design of upper saddle 30 described above essentially implements a "pulley". Pins 60 are the center of rotation for this "pulley" and the length of upright 32 defines its radius. The "pulley" diameter may be variable and, in the preferred embodiment, is 150 times the diameter of catenary cable 16. Although the design handles forces conceptually as does a pulley, there are obvious structural differences. For instance, rotation of upright 32 about pins 60 is constrained to a 7° deviation from the vertical norm. This rotation in upper saddle 30 prevents the introduction of high moments to pylon 17 present for the rigid pylons 18 of the system disclosed in the Müller '765 patent.

In the preferred embodiment, lower saddle 200 is designed to accommodate articulation of upright 32, and transmit the vertical and lateral loads applied across a portion of track cable 14 to pylon 17, which ultimately transmits the loads to the ground. In this manner, the lower saddle transmits loads developed by vehicle 12, cables 14, the weather, and deviation of upper saddle 30 (up to 3 degrees). Furthermore, lower saddle 200 provides for smoother transition from one pylon span to another and increases the comfort of the vehicle's passengers by reducing the curvature of track cable 14.

Figure 7H:
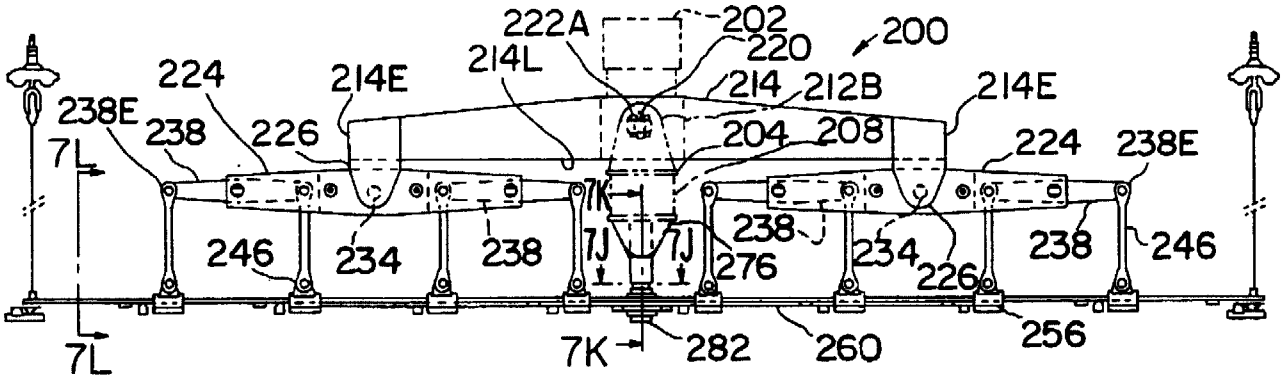
FIG. 7H illustrates an elevational view of the lower saddle of the pylon in FIG. 6.
Figure 7I:
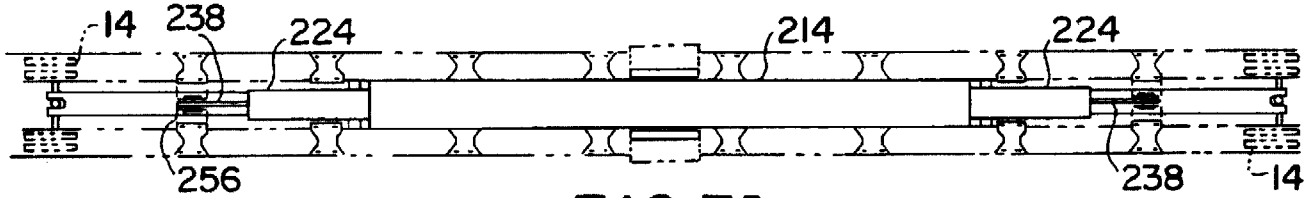
FIG. 7I is a plan view of FIG. 7H.
Figure 7K:
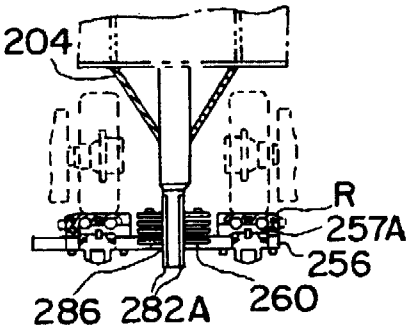
FIG. 7K is an elevational view taken along section 7K—7K in FIG. 7H.
Figure 7J:
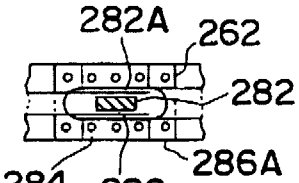
FIG. 7J is a plan view taken along section 7J—7J in FIG. 7H.
Figure 7L:
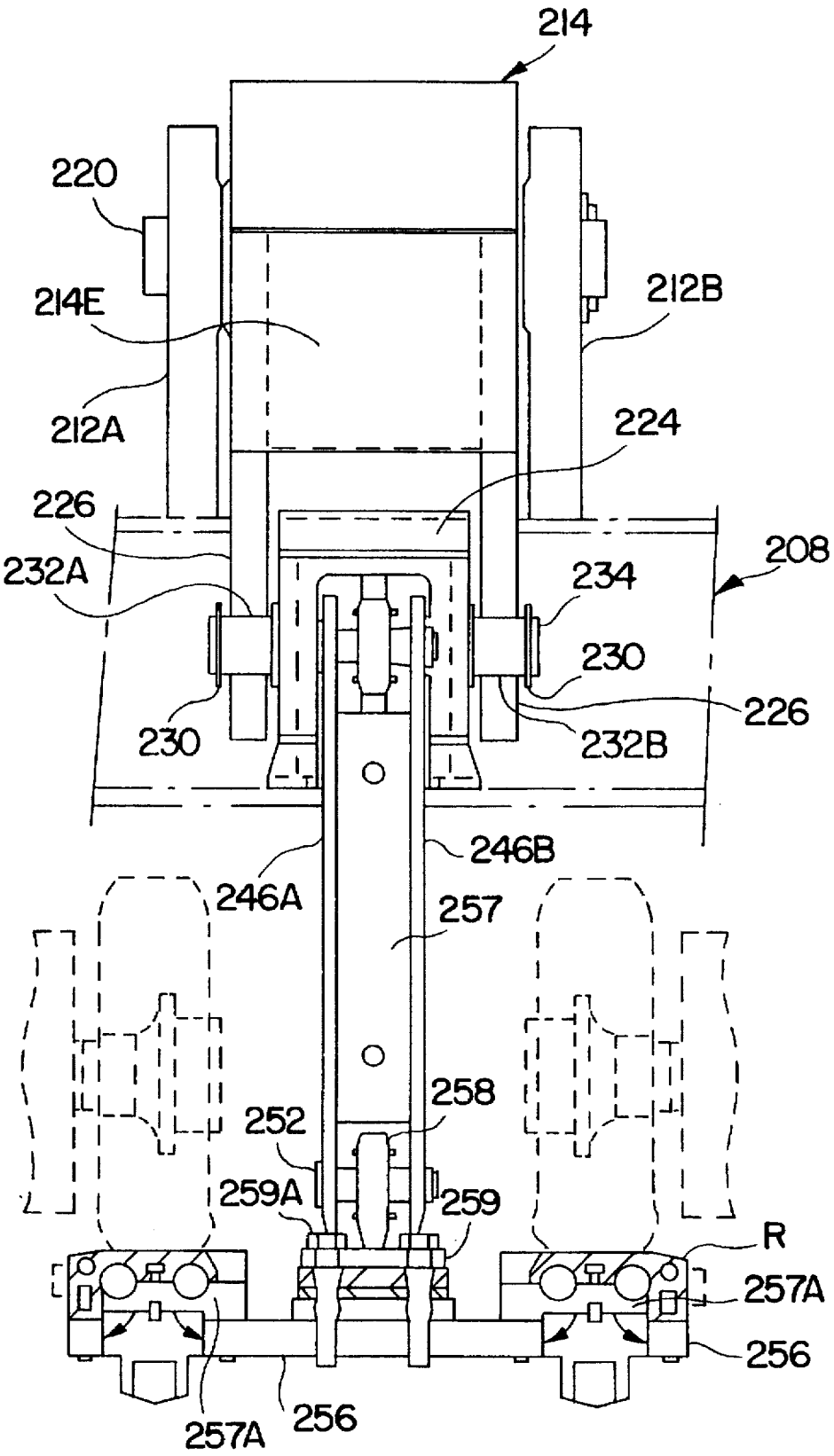
FIG. 7L is an elevational view taken along 7L—7L in FIG. 7H.
Figure 7N:
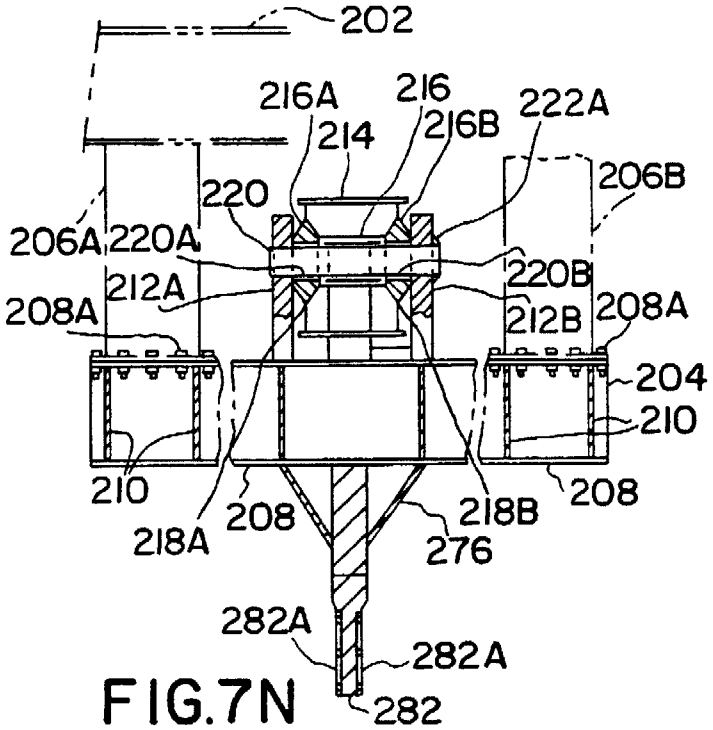
FIGS. 7M–N and 7P illustrate the transverse connecting frame and main beam of the lower saddle.
Figure 7Q:
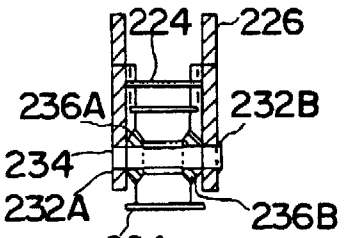
FIG. 7Q is an elevational view taken along section line 7Q—7Q of FIG. 7M.
Figure 7M:
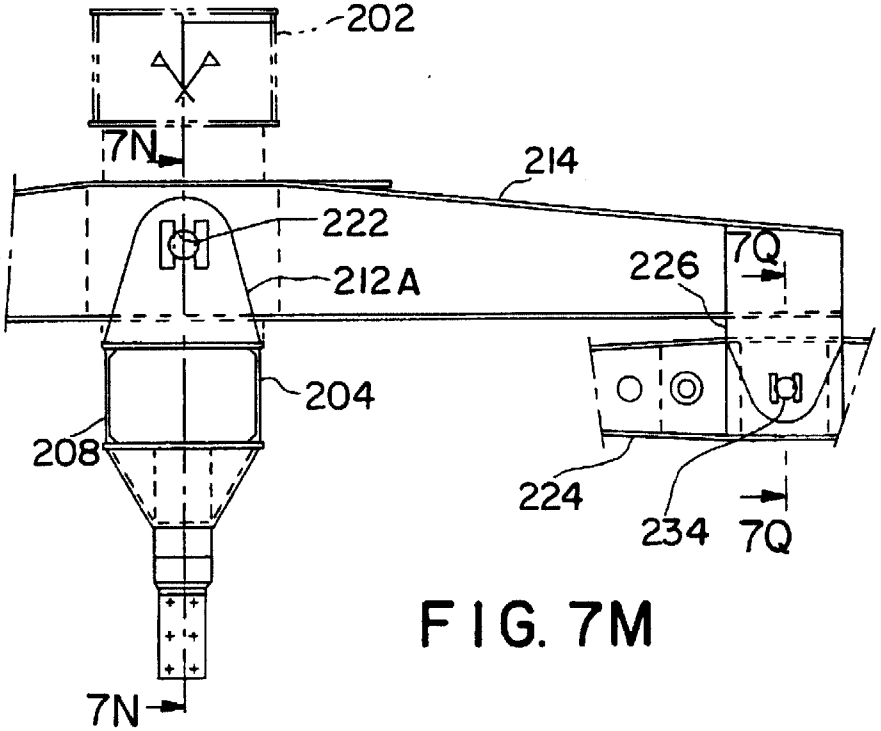
Figure 7P:
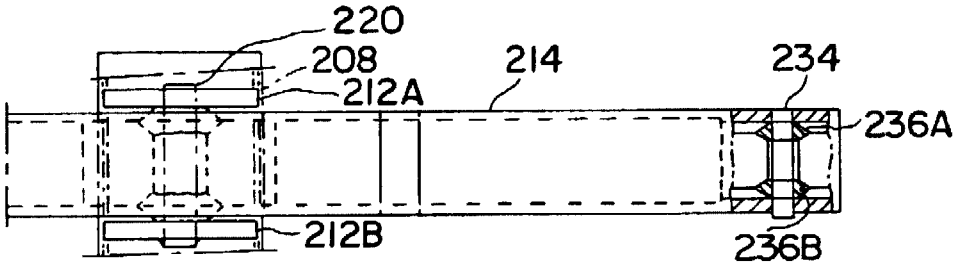
Figure 7T:
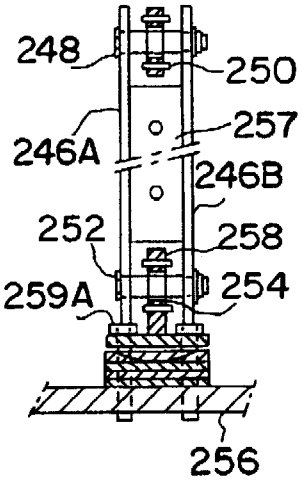
FIGS. 7R–7U illustrate the tertiary beams and suspension rod/cross tie assemblies of the lower saddle.
Figure 7S:
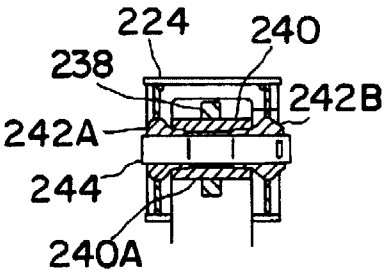
Figure 7R:
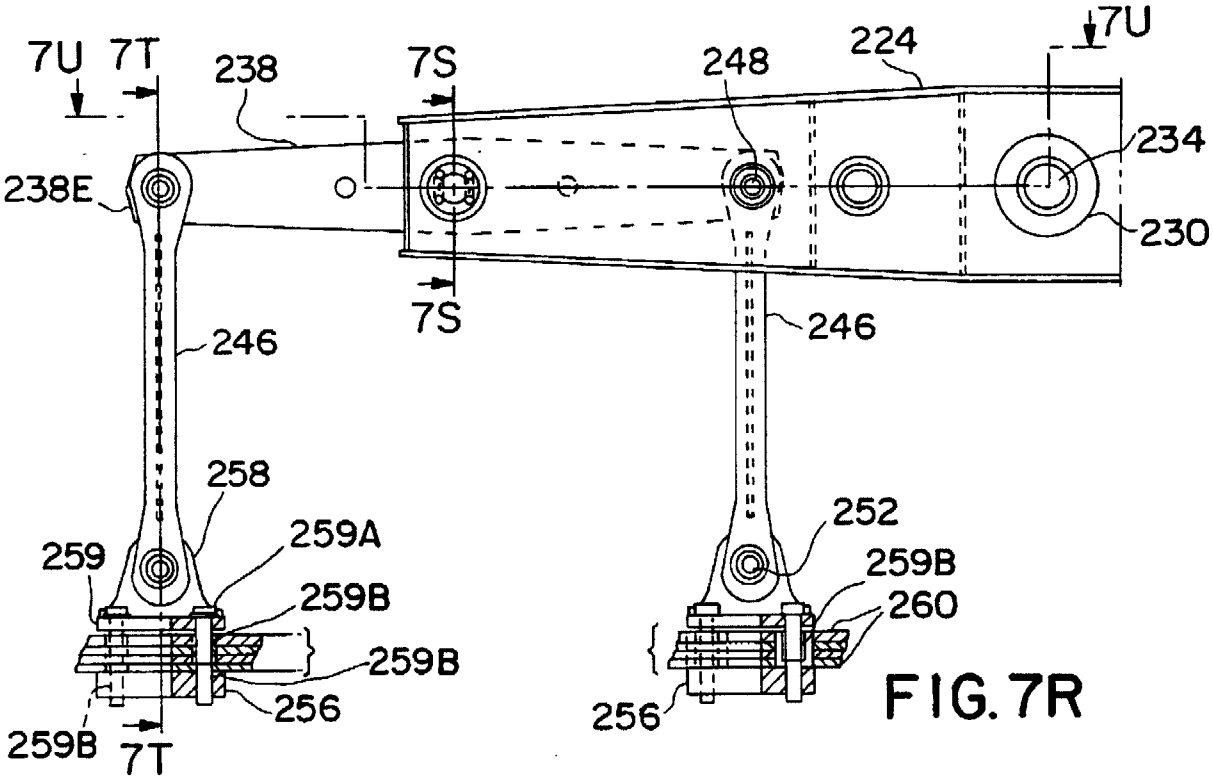
Figure 7U:
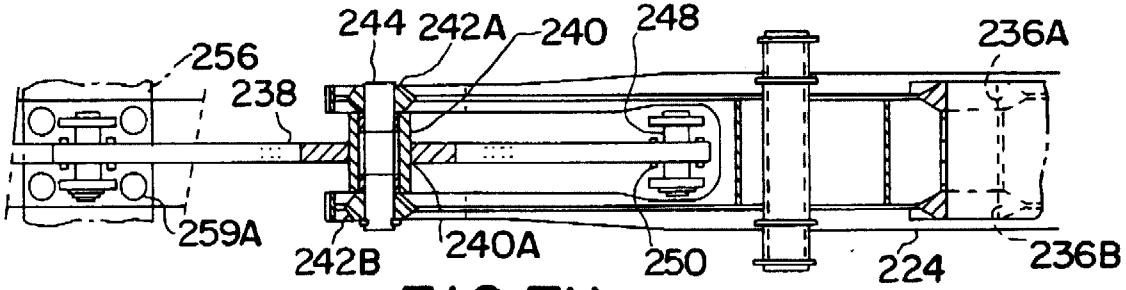
Figure 7V:
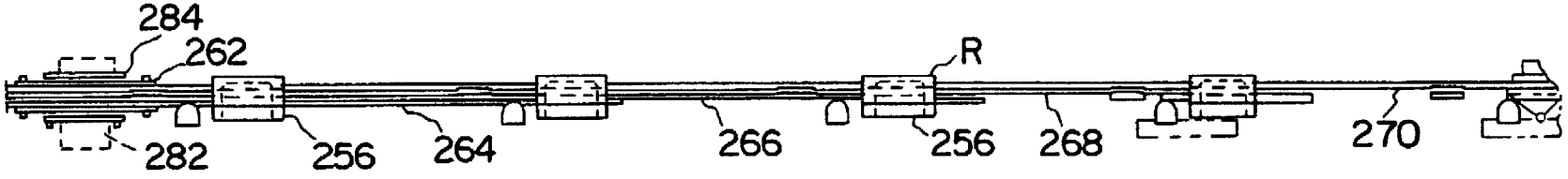
FIGS. 7V–7X illustrate the equalizing beam of the lower saddle.
Figure 7W:
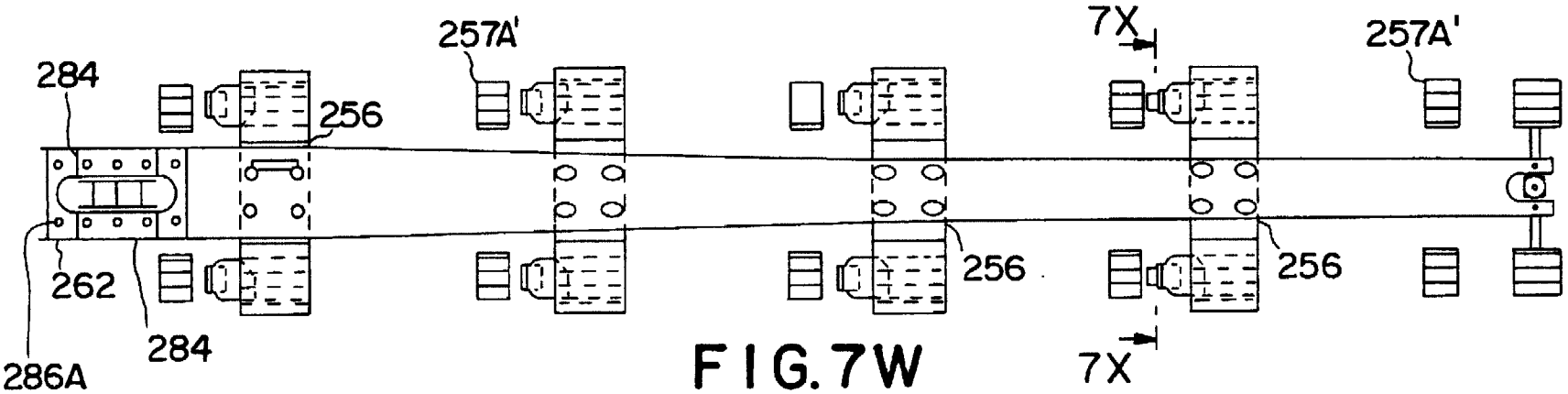
Figure 7X:
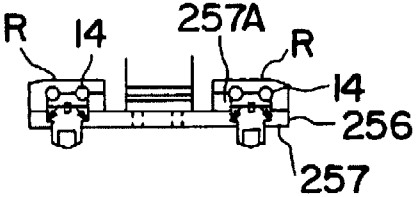

Lower saddle 200, represented in detail by FIGS. 7H–7X, is connected to pylon base 21 beneath pylon upright 32 by way of transverse pylon beam 202, that is mounted transversely to and extending outwardly from either side of base pylon 21. This connection between the lower saddle and pylon base 21 is also illustrated in FIG. 6.

U-shaped transverse connecting frame 204 is connected to one end of transverse pylon beam 202 and extends downwardly therefrom to accept and transmit lateral and vertical forces to pylon 17. Actually, a second identical transverse connecting frame extends downwardly from the other end of transverse pylon beam 202, providing a second guideway on the other side of each pylon, but only one such frame 204 will be discussed herein to avoid redundancy. With reference to FIGS. 7M and 7N, transverse connecting frame 204 includes two vertical suspension beams 206A, 206B connected to transverse pylon beam 202 and extending downwardly therefrom. Suspension beams 206A and 206B are connected by horizontally positioned transverse beam 208 by way of bolted connections 208A. Webs 210 are welded to and extend vertically across transverse support beam 208 for added stability. Bearing plates 212A and 212B are welded to and extend upwardly from transverse support beam 208. The assembly of the horizontal and vertical beams, and other associated hardware thus forms the structural skeleton of transverse connecting frame 204.

A vertical load transmission system is pivotally connected to transverse connecting frame 204 for transmitting vertical loads developed by the vehicle and cables, as well as those loads developed by articulation of the upper saddle, to pylon 17 through the transverse connecting frame. A primary requirement of the vertical load transmission system is that vertical loads transmitted by the system should be well distributed over a portion of the track cables to avoid high curvatures in the cables. Accordingly, the vertical load transmission system is preferably an isostatic system of articulated beams and bars arranged in a hierarchical manner.

More specifically, with reference to FIGS. 7H and 7L, main beam 214 is a welded plate assembly formed in rectangular cross-section, and is pivotally mounted through its side walls at the center of its longitudinal axis to bearing plates 212A and 212B for rotation in a vertical plane. Main beam 214 is bi-symmetrical and has a variable height defined by a sloped upper surface that peaks at its center directly above its pivotal mounting point and slopes downwardly towards its ends 214E. Lower surface 214L of the main beam is flat and extends horizontally between ends 214E.

Dumbbell-shaped collar 216 is mounted at its disc-like ends 216A and 216B across the sides of the main beam in circular openings 218A and 218B, respectively, as shown in FIGS. 7N. Shaft 220 is mounted through the longitudinal axis of collar 216 and extends out of ends 216A, 216B through cylindrical openings 220A and 220B therein, respectively. The ends of shaft 220 further extend through openings 222 and associated radial bearings 222A in bearing plates 212A and 212B of the transverse connecting frame, as indicated in FIGS. 7H and 7N, thereby supporting the main beam for rotation relative to the pylon. Bearings 222A are bronze to reduce friction.

A pair of secondary beams 224 are pivotally mounted at the centers of their respective longitudinal axes to flanges 226 connected to and extending downwardly from locations near the respective ends 214E of the main beam, enabling rotation of the secondary beams relative to the main beam in the same vertical plane that the main beam is rotatable within. Flanges 226 are equipped with openings 232A and 232B, respectively, for mounting shafts 234 therein, as displayed in FIGS. 7L and 7Q. Shafts 234 pass through discs 236A and 236B mounted within circular openings in respective secondary beams 224, pivotally connecting the secondary beams to flanges 226 near each end of the main beam. Rings 230 retain shafts 234 in place. Like main beam 214, the secondary beams are formed of a welded plate assembly that results in a variable height and a rectangular cross-section.

Four tertiary beams 238, also of rectangular cross-section, are each pivotally mounted at the center of its longitudinal axis to one of respective secondary beams 224 substantially at a respective end of the secondary beam for rotation in the same vertical plane that the main and secondary beams are rotatable within. Referring to FIGS. 7S and 7U, tertiary beams 238 carry collars 240 in circular openings 240A. These collars are aligned with two respective sets of complementary discs 242A and 242B, one set of discs 242A, 242B being mounted in circular openings near each end of secondary beams 224. Shafts 244 extend through aligned openings in the respective disc-collar-disc assembly 242A, 240, and 242B to pivotally connect the centers of tertiary beams 238 to the respective ends of secondary beams 224 in a conventional manner. The end portions of the upper and lower faces of secondary beams 224 are cut open somewhat to permit unimpeded movement of tertiary beams 238.

Eight suspension rods 246 are each pivotally mounted at their upper ends to each of respective ends 238E of the tertiary beams for rotation in the vertical plane. Bolts 248 pass through circular openings in each of the suspension rod halves 246A, 246B as well as a circular opening in each of the ends of tertiary beams 238. Spherical bearings 250 are positioned about bolt 248 to facilitate relative rotation between the suspension rods and the tertiary beams, and to maintain the spacing between the suspension rod halves. Similar bearings are provided at other interfaces where components rotate relative to one another throughout the lower saddle, in conventional fashion.

The other end of each suspension rod 246 is pivotally connected to a cross-tie 256 by way of flange 258 that extends upwardly from connecting plate 259. Cross-ties 256 function to transmit vertical and lateral vehicle loads to the vertical and lateral load transmission systems, via the engagement of the vehicle wheels with the rails carried by the cross-ties. Connecting plate 259 is bolted via four bolts 259A about the intersection of the cross-tie's longitudinal axis with the axis of an equalizing beam (described below), enabling rotation of cross-ties 256 in the vertical plane relative to the suspension rods. As shown in FIG. 7H, bolts 259A actually consist of four sets of bolts of varying lengths to accommodate the differing thicknesses of the equalizing beam across lower saddle 200.

Bolts 252 pass through circular openings at the bottom of suspension rod halves 246A, 246B and complementary openings through flanges 258. The suspension rod halves are connected with welded web 257 that effectively provides an I-section to minimize the risk of instability in the suspension rods. Spherical bearings 254 again facilitate relative rotation and maintain the spacing between the suspension rod halves. Rod halves 246A, 246B are enlarged at each of their ends for the pivotal connections to the tertiary beams and the cross-ties, respectively, as shown in FIG. 7R. This articulation of the suspension rods at both ends prevents the rods from taking any moment due to lateral forces which, as explained below, are devoted to the equalizing beam.

Cross-ties 256 are different from cross-ties 25 on the pylon spans because the function of cross-ties 256 is to transmit a vertical upward force rather than a vertical downward force. Referring to FIG. 7X, cross-ties 256 include flat plates 257 to which grooved blocks 257A are welded to serve as a bearing for track cables 14. A rail is provided in the form of a second grooved block R that is used to clamp the carrier cables to the cross-ties. Three rows of bolts are used to secure grooved blocks R to flat plate 257, as shown in FIG. 7W. Interim cable track support sections 257A' are provided between cross-ties 256 and are connected to grooved blocks 257A to form a continuous bearing cradle for track cables 14. Grooved blocks R are butterfly shaped, as viewed in FIG. 7W, resulting from symmetrical grooves cut into each end. Interim rail sections, not shown, having tongued ends for engaging the grooved ends of the blocks R and are connected thereto to form a continuous rail for supporting the vehicle wheels along the length of the lower saddle.

Lower saddle 200 further includes a lateral load transmission system that contains equalizing beam 260 carried across the cross-ties, and lateral support stud 282 carried by transverse connecting frame 204. Thus, equalizing beam 260 spans transversely across the lower saddle's cross-ties 256 to transmit lateral forces to lateral support stud 282. The equalizing beam further serves to stabilize suspension rods 246 in the face of lateral forces. The equalizing beam must be flexible in the vertical direction so that the vertical load transmission system operates effectively as an isostatic system, but also must be reasonably stiff in the lateral direction to transmit lateral forces.

To meet these seemingly contradictory requirements, equalizing beam 260 includes superimposed plates 264, 266, 268, and 270 of different lengths and thicknesses, as displayed in FIGS. 7V and 7W. Thus, plate 264 is shorter than plate 266, which is shorter than plate 268, and so forth. Also, as particularly shown in FIG. 7W, the widths of the plates are greatest at the center of their longitudinal axes and decrease along the lengths of the plates towards each of their ends. This variable width, plus the variable thickness of the super-imposed plate stack, decreases the lateral and vertical inertia of the equalizing beam at its end where it is least needed.

Lateral and vertical loads are transmitted at cross-ties 256 by four bolts 259A that connect the cross-ties to both the vertical and lateral load transmission systems, which operate independently from one another. Thus, as explained above, cross-ties 256 are connected to suspension rods 246 and equalizing beam 260 using bolts 259A. Referring to FIGS. 7R and 7T, the bolts are fixed in threaded holes 259B in the cross-ties for better transmission of lateral forces than if secured with nuts.

The plates of equalizing beam 260 are clamped together near their center by tightly bolting the plates together along with the center-most cross-ties 256 and suspension rods 246 using bolts 259A, as displayed in the left-most equalizing beam 256 of FIG. 7W. The plates of the equalizing beam should otherwise, i.e., outside of the center, be free to move longitudinally. This freedom of movement is realized by using a teflon coating between the plates that provides for maximum vertical flexibility, and by making the bolt holes in the plates that are aligned with the other cross-ties slotted in the longitudinal direction. Pipe sleeves 259B are provided in these slotted bolt holes that are slightly taller than the equalizing beam's plate stack to avoid clamping the plates outside of their centers, as shown in the lower portion of FIG. 7R. This allows vertical loads that are transmitted from cross-ties 256 to suspension rods 246 to effectively bypass equalizing beam 260.

Referring to FIG. 7N, the lateral load transmission system is further connected to transverse connecting frame 204 and extends downwardly therefrom in the form of lateral support stud 282 to provide for lateral rigidity of the track cables and to sustain wind loads. Lateral support housing 276 is connected to and extends downwardly beneath transverse support beam 208. Lateral support stud 282 is encased within housing 276 and extends downwardly through the center thereof.

The lower portion of steel lateral support stud 282 is tapered and extends downwardly through respective aligned grooves 286 formed through clamping plates 262 as well as each of the plates of the equalizing beam, as shown in FIGS. 7J and 7K. External contact faces of the stud are chromium plated, and are capped with plates 282A made of a tough steel material, e.g., quenched and tempered steel. Clamping plates 262 are provided with guide blocks 284 for engaging lateral support stud plates 282A and limiting the motion of stud 282 within groove 286 to linear motion along the axis of the equalizing beam. Guide blocks 284 are also made of a tough steel material in order to sustain the high contact pressure at the lateral support stud plates. A plurality of bolts 286A are positioned in aligned bores through the assembly of clamping plates 262, guide block 284, and equalizing beam 260 about grooves 286 and secured with nuts to clamp the assembly. In this manner, lateral movement of the cross-ties, as well as track cables 14 supported at each of the ends thereof, is controlled.

Thus, lateral loads resulting from the wind and deviation (up to 3 degrees) of the upper saddle are applied through cross-ties 256 and equalizing beam 260 to lateral support stud 282. The lateral forces are then transmitted through transverse connecting frame 204, which carries the lateral support stud, to transverse pylon beam 202 and the pylon.

Referring again to FIGS. 6 and 7B, together pylon 17 and upper saddle 30 pivotable on pins 60 constitute an articulative leg deviating from a strict vertical orientation in response to loads on catenary cable 16 up to 3°. When engaged with coupling 40 and joined by pin 44, cable connectors 42 can rotate relative to coupling 40. The relative rotation of cable connectors 42 and coupling 40 is a response to loads on upper saddle 30 received via catenary cable 16, and permits deviation of the articulative leg. As stated above, bottom saddle 200 is designed to accommodate this deviation and, through equalizing beam 260, to (1) minimize in-plane rigidity and (2) provide lateral rigidity to sustain wind load and forces of pylon 17's deviation from the strict vertical orientation. Through this articulative leg and bottom saddle described above, the present invention contravenes the art by providing self-adjusting pylons 17, and provides for a smooth transit of vehicle 12 across the system in accordance with regulatory guidelines.

Figure 8A:
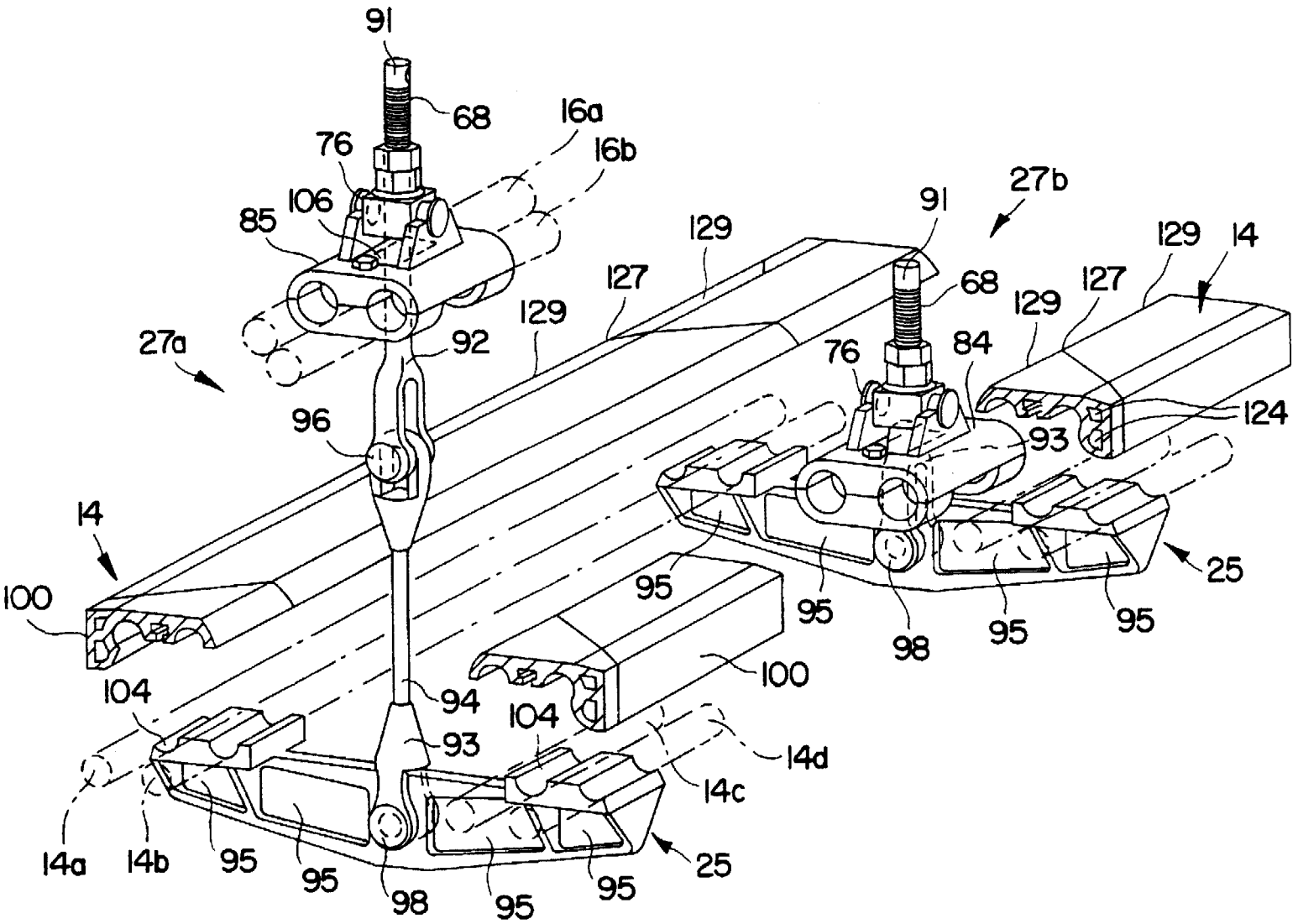
FIGS. 8A–B illustrate the hangers, cross-ties, and rails of the track cable in the new system in a perspective view.

The cables, rails, and cross-ties of the new system are illustrated in FIGS. 8A–10C. FIG. 8A is a perspective, partially exploded view of hangers **27*a–b*, cross-ties 25, and carrier rail 14 of the present invention replacing the counterparts in the Müller '765 patent depicted in FIG. 2. FIG. 8B is a frontal, elevational view of long hanger 27*a* and cross-tie 25 and shows the relationship of vehicle 12** to one such hanger/cross-tie combination in ghosted lines.

Figure 8B:
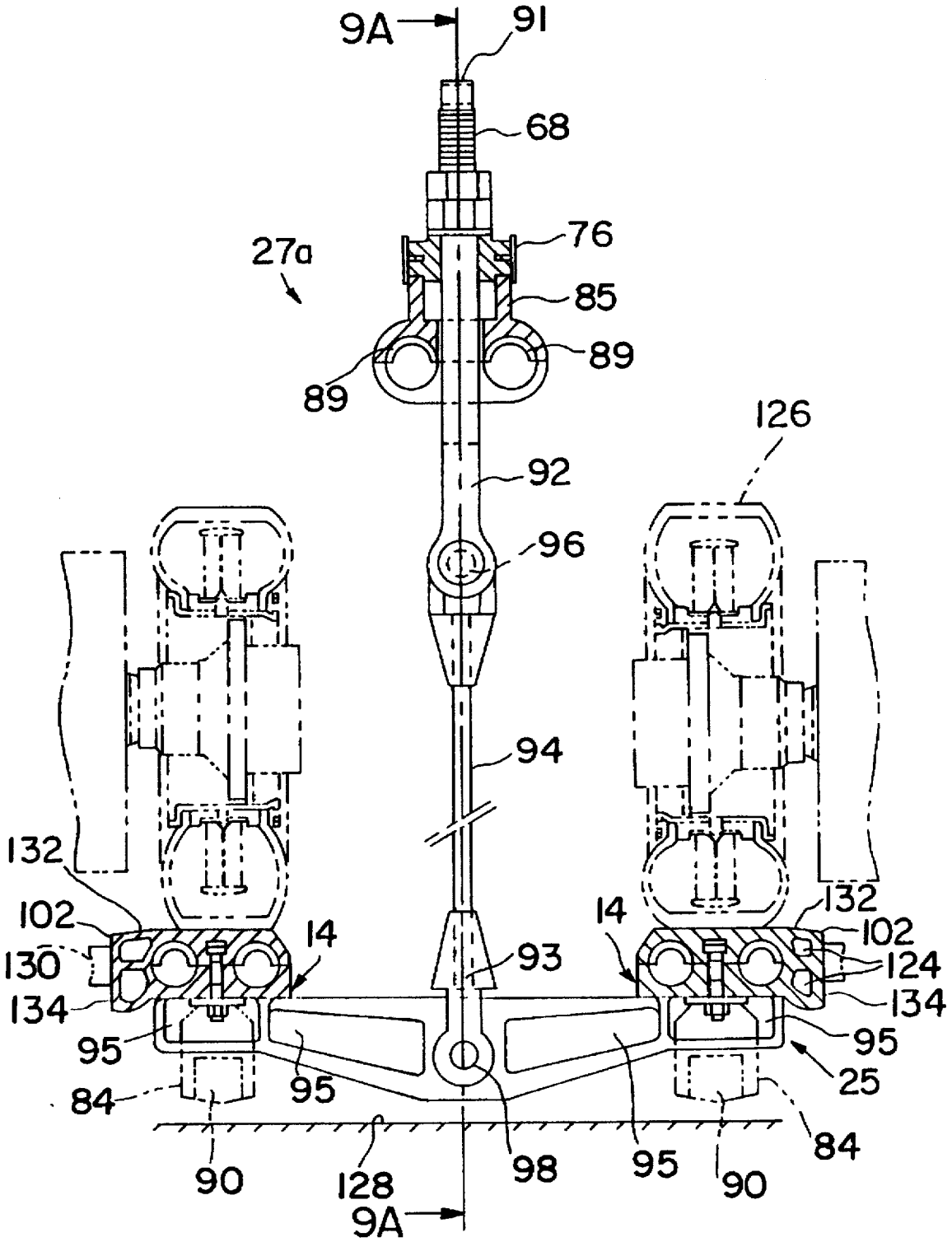
Figure 9A:
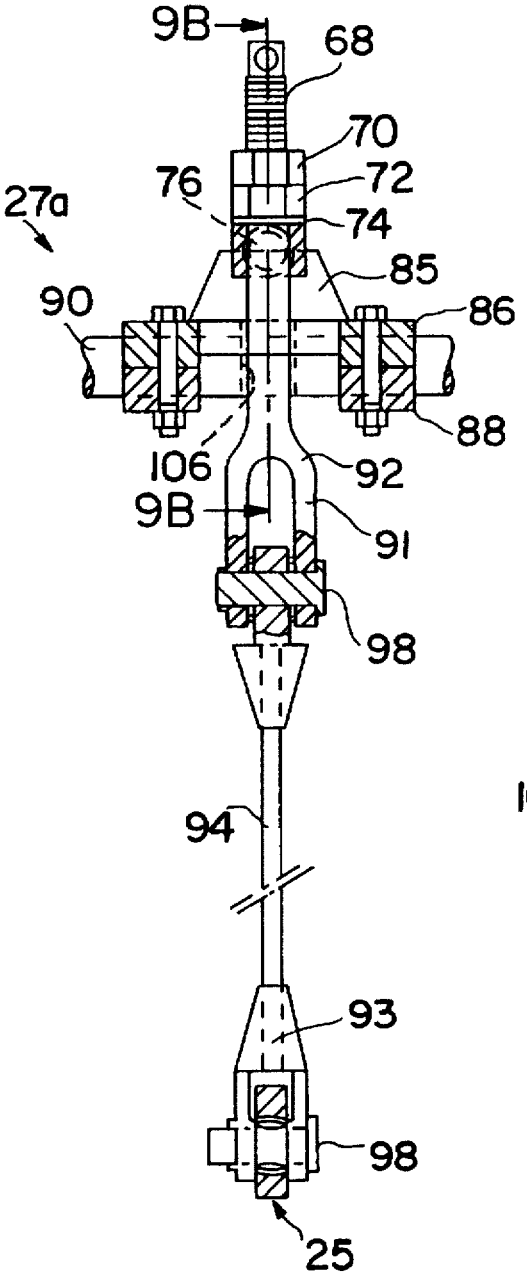
FIGS. 9A–B illustrate the hangers, cross-ties, and power rail of the new system in section along line 9A—9A of FIG. 8B and in partial cutaway.
Figure 9B:
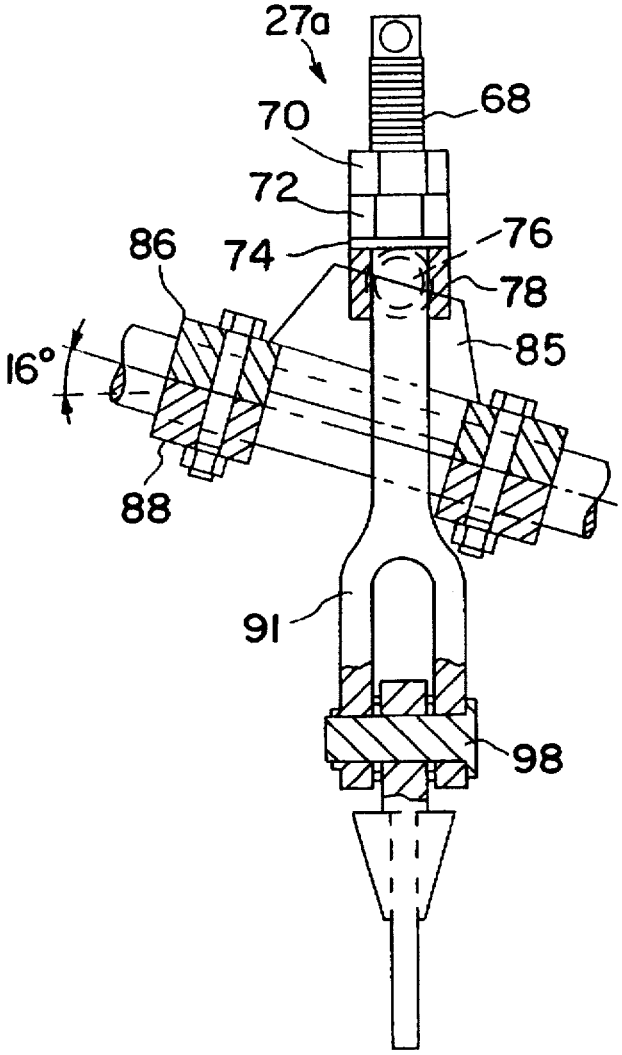

FIGS. 9A–C provide additional views of hanger **27*a*: FIG. 9A in section and partial cutaway along line 9A—9A of FIG. 8B; FIG. 9B in section along line 9B—9B of FIG. 9A; and 9C in the same view as 9A illustrating the movement of power rail 90 and guide 84 relative to hanger 27*a* described below. FIGS. 10A–C depict rail 100, cables 14*a–b*, and cross-tie 25. FIG. 10A in a top view, FIG. 10B is section along line 10B—10B of FIG. 10A in partial cutaway, and FIG. 10C in a front view of rail 100 and bottom guide 102**.

Figure 1:
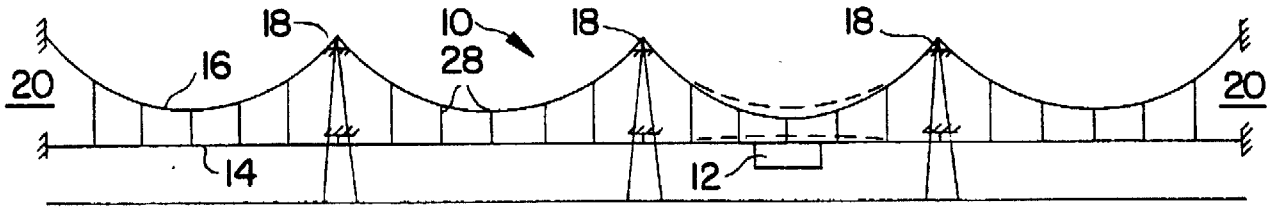
FIG. 1 PRIOR ART
FIGS. 1–5 illustrate a prior art cableway system disclosed and claimed in U.S. Pat. No. 4,069,765 issued Jan. 24, 1978 to Gerhard Müller and correspond to FIGS. 3–7 therein.
Figure 2:
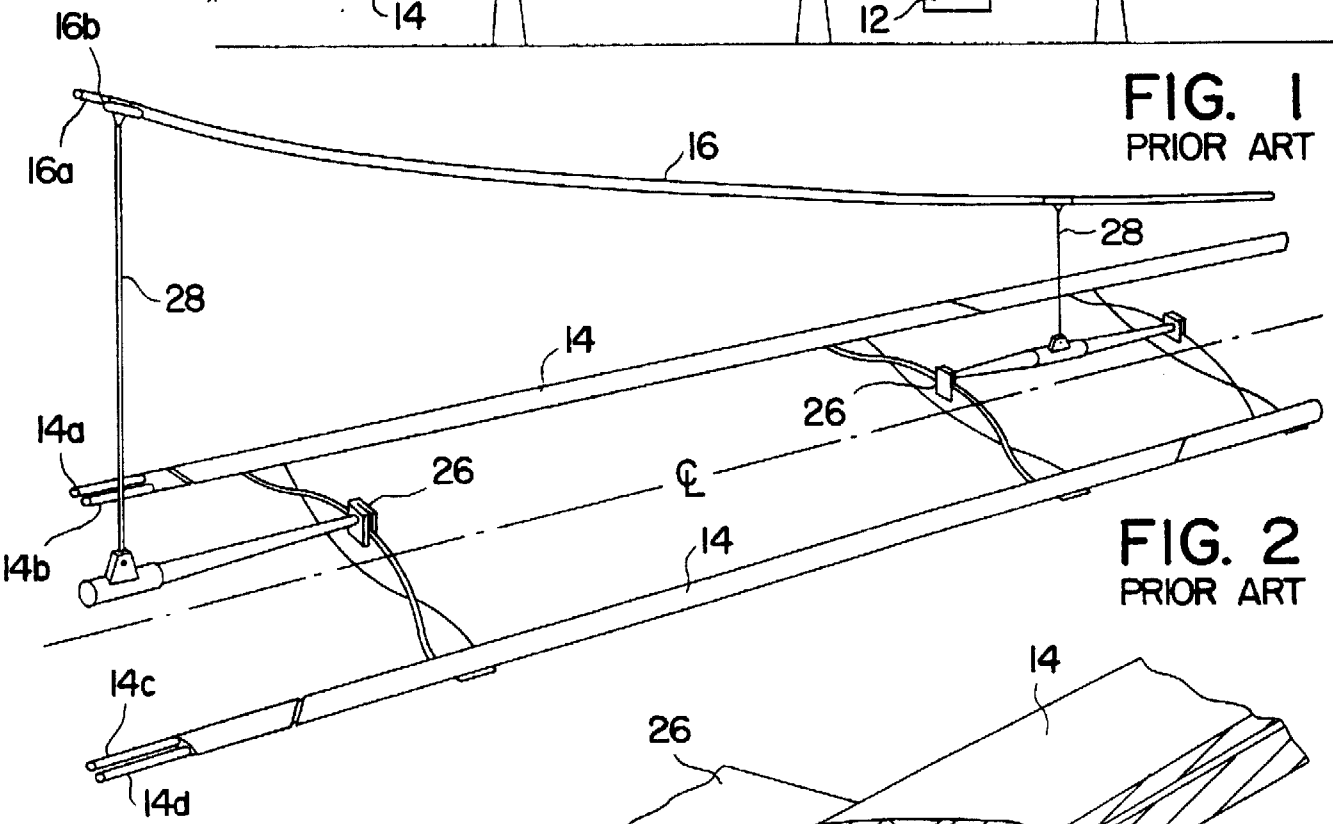
FIG. 2 PRIOR ART
Figure 3:
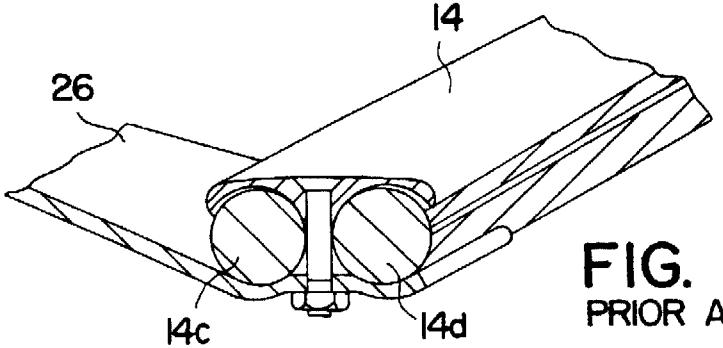
FIG. 3 PRIOR ART
Figure 4:
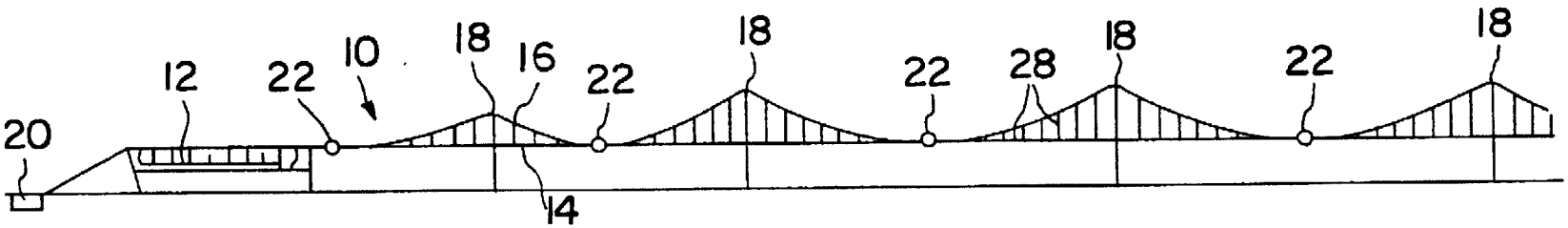
FIG. 4 PRIOR ART
Figure 5:
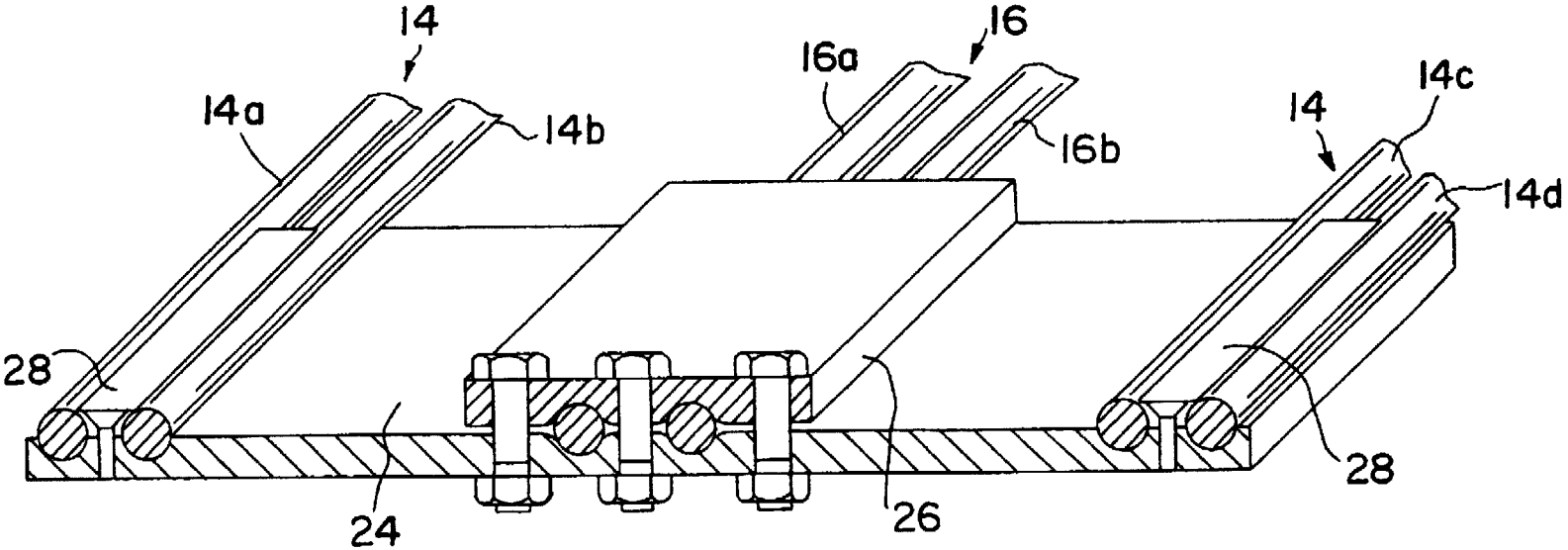
FIG. 5 PRIOR ART

Returning to FIG. 8A, two alternative embodiments for hanger 27 are shown: long hanger **27*a* and short hanger 27*b*. As is shown in FIG. 2, both long and short hangers are used depending on the hanger's distance from pylon 17 and span midpoint 22 shown in FIG. 4. In addition to differing lengths, hangers 27*a–b* differ in that hanger member 91 of hanger 27*a* is a locked-coil steel cable but in hanger 27*b* is a rod. Furthermore, short hanger 27*b* can be used in different lengths using the same construction. Two different lengths are used for short hanger 27*b*** in a single 600 m span in the preferred embodiment.

The length of hangers **27*a–b* is calculated to pre-tension track cable 14 as described above, to transmit vertical, pre-tensioning forces to pylon 17, and to ensure clearance between catenary cable clamp 85 and vehicle 12 in high winds, and so the length thereof will depend on the particular application for a given embodiment. The effective length of hangers 27*a–b* can be adjusted by tightening and loosening nuts 70 and 72 on threaded end 68 of hanger member 91 described below to adjust the pre-tensioning forces. The length of the threads on threaded end 68 must consequently be sufficient to accommodate the desirable range of tensions. In long hanger 27*a*, this will nominally be a 0–300 mm and in short hanger 27B** the length will vary but be at least greater than 50 mm.

Hangers **27*a–b* are suspended from catenary cable 16 by clamping cables 16*a–b* in grooves 87*a–b* of suspension clamp 85 shown in FIG. 8A. Suspension clamp 85 is pivotably mounted to hanger member 91 at pivot 76. Suspension clamp 85 comprises first guide member 86 bolted to lower guide member 88 as shown in FIGS. 9A–B. Suspension clamp 85 includes passage 106 through which threaded end 68 of hanger member 91 extends, and block 78 joined to first guide member 86 at pivot 76 such that catenary cable 16 and suspension clamp 85 may pivot relative to hanger member 91 16° relative to the horizontal normal as shown in FIG. 9D. Block 78 includes a bore 108 through which threaded end 68 of hanger member 91 extends until block 78 rests on shoulder 110 formed on threaded end 68 and is secured thereagainst by nuts 70 and 72 and washer 74**.

Disadvantages to clamping cable 16 typically include cable fatigue and the "beam effect", in which cable behaves structurally as a beam. Suspension clamp 85 minimizes these disadvantages by including trumpet-like openings 89 in grooves **87*a–b* as shown in FIGS. 9A–9B. Trumpet-like openings are also employed in equalizing locks 300 discussed below and shown in FIGS. 11A–D**.

Hanger member 91, as shown in FIGS. 8A–B, of long hanger **27*a* is jointed and includes upper piece 92, a threaded fork, and lower piece 94, a cable, moving relative to one another at joint 96; hanger member 91 of short hanger 27*b* is not jointed. The articulation provided by joint 96 and pivot 76 provides flexibility in hanger 27*a* that will reduce bending moments therein resulting from the loads of power rail 90 and vehicle 12, as well as other forces. Hence, the elimination of joint 96 in hanger 27*b*, in which bending moments are of less concern because of the shorter length of hanger member 91, and the inclusion of pivot 76, occasioned suspending hanger 27*b* from catenary cable 16**.

Referring still to FIGS. 8A–B, cross-tie 25 is an asymmetric I-beam mounted to the hanger member 91 at pivot 98 at collar 93 of hanger member 91 distal to catenary cable 16 (not shown) in both long hanger **27*a* and short hanger 27*b*. Pivot 98 is a spherical plain bearing providing flexibility and thereby reducing flexural effects in cables 14 and 16. Cross-tie 25 is preferably constructed from cast steel and is I-shaped in cross-section as shown in the perspective view of FIG. 8A and in the cross-sectional view of FIG. 10B. Openings 95 are either cast or milled in cross-tie 25 to reduce weight and, consequently, the load on catenary cable 16**.

Cables 14*a–d* of track cable 14 are shown in ghosted lines in FIG. 8A. Track cable guides 102 comprising bottom guide members 104 and rails 100 joined as shown more fully in FIGS. 10A–C are mounted to opposite ends of cross-tie 25 as shown in FIGS. 8A–B. Guide members 104 may be either formed integrally with or bolted to cross-tie 25 as best shown in FIG. 10B by bolts 114 extending through bores 116 and secured by nut and washer combinations 118. Still referring to FIGS. 10A–C, rails 100 are then mounted by mating bolts 114 with slot 120 in rail 100 and sliding rails 100 until properly positioned as shown in FIG. 10C. When rails 100 are properly positioned relative to guides 104, rails 100 and guides 104 define grooves 122 shown in FIG. 10C through which cables 14*a–d* are strung as shown best in FIGS. 10A–B and in ghosted lines in FIG. 8A.

Rails 100 constructed of aluminum comprise modular segments that typically are in sufficiently large to span the entire distance between hangers 27. Although one end of each segment will be relatively fixed in position by the mating of bolts 114 to slot 120 as discussed above, the other end will be softly, rather than rigidly, fixed by the mating of grooves 122 with cables 14*a–d*. The movement thereby permitted accommodates thermal expansion of the segments and is therefor desirable. Thus, thermal expansion joints 127 are created between rail segments such as joint 127 between segments 129 shown in FIGS. 8A, and 10A–B. Joints 127 are preferably angled at 45° relative to the longitudinal axis of rails 100. Rails 100 also include upper surfaces 132 and sides 134 providing a smooth and gliding surface for vehicle 12 in the preferred embodiment as discussed below. Although not shown, the preferred embodiment includes a layer of insulation between rails 100 and cables 14*a–d* to avoid corrosion and reduce noise.

Other modifications may be employed in the design of rails 100. For instance, holes 124 are milled into individual segments of rails 100 to decrease weight and the heads of bolts 114 need not be of uniform height above cross-tie 25 if one desires to incline segments of rails 100. One may furthermore provide some means for heating rails 100 for use in particularly cold climates. These and other such modifications are considered within the scope of the invention.

As is known to those in the art, vehicle 12 must be powered as it traverses the system and so provision must be made for power rail 90 as shown in FIGS. 8B and 10B. Power rail 90 may be mounted to cross-tie 25 as shown in ghosted lines in FIGS. 8B and 10B. Power rail 90 is grasped by power rail guide 84 bolted to plate 112, which in turn is bolted to the bottom of cross-tie 25. As shown in FIG. 9A, a power rail 90 and power rail guide 84 are preferably mounted to each end of cross-tie 25 in this variation. Also as is known in the art, power rail 90 must be electrically insulated from all other parts of the system for safety reasons.

The relation of vehicle 12 to the combination of hanger 27, cross-tie 25, and track cable 14 is best illustrated in FIG. 8B. Carrier wheels 126 mounted on either side of vehicle roof 128 in any convenient manner (not shown) rotate in the vertical plane, ride on the upper surface 132 of rails 100, and carry the weight of vehicle 12. Guide wheels 130 rotate in the horizontal plane, contact sides 134 of rails 100, and maintain the lateral position of vehicle 12 vis-a-vis the carrier rails.

Figure 11B:
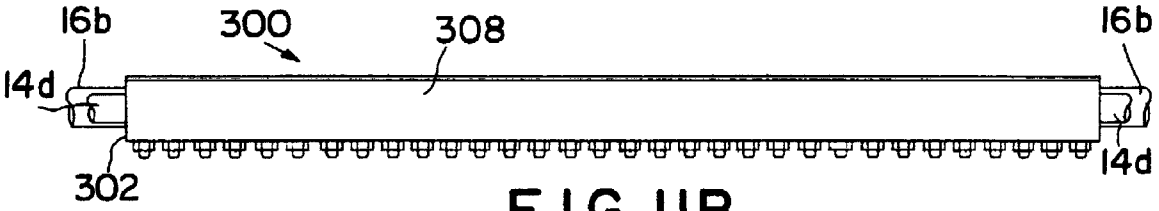
FIGS. 11A–D illustrate the equalizing lock tying the catenary and track cables at span midpoints in the new system.
Figure 11A:
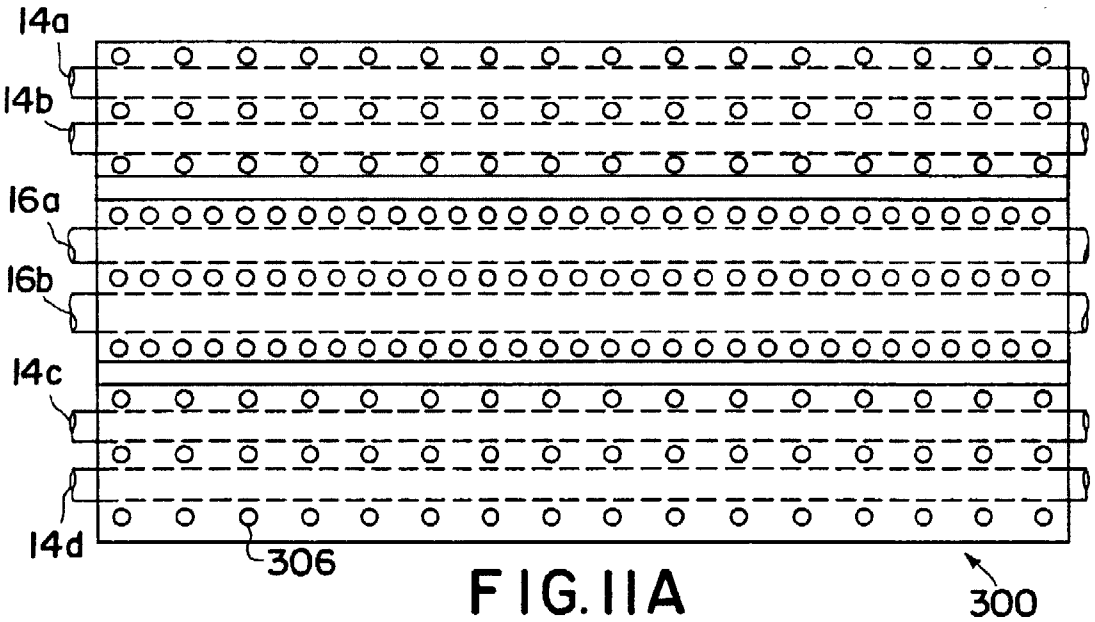
Figure 11D:
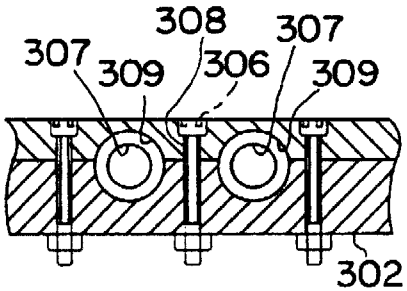
Figure 11C:
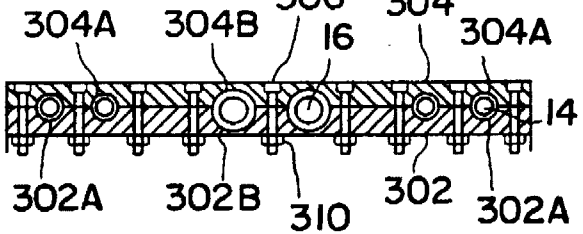

Referring now to FIGS. 11A–D, equalizing locks 300 are provided for joining catenary cables 16 to track cables 14 midway between the pylons to equalize the tension between the catenary and track cables. Equalizing locks 300 prevent relative horizontal motion between catenary cable 16 and track cable 14 by dissipating shear forces therebetween through friction on the cables. As such, the equalizing lock reduces the maximum deflection of the guideway by impeding relative movement between the cables. Locks 300 include steel force equalization plate 302 having three sets of parallel channels formed along the length of the upper surface thereof for accepting catenary cables 16 in the center two channels 302B and track cables 14 in the outer four channels 302A. Thus, the channels are shaped to approximate one-half of the respective cable circumferences except that the ends of the channels are flared outwardly, as illustrated in FIGS. 11C and 11D.

Steel clamping plates 304 also have three sets of parallel channels that are formed along the length of the lower surface thereof for accepting catenary cables 16 in center channels 304B and track cables 14 in outer channels 304A. Like the channels of the force equalization plates, the channels of the clamping plates are shaped to approximate one-half of the respective cable circumferences except that the ends of the channels are flared outwardly.

As shown in FIGS. 11C and 11D, the channeled surfaces of respective force equalization plates 302 and the clamping plates 304 are complementary such that the plates may be assembled about the cables for frictionally locking the cables within the respective channels to equalize the tension in the catenary and track cables. The respective flared ends of the channels in the assembled plates form a frusto-conical cavity in each end of the assembly about each of the cables for reducing wear on the cables by limiting engagement, and therefore bending stresses, with the ends of the plates, a feature lacking in the Müller disclosure. The flared ends, described above as trumpet-like or trumpeted openings for suspension clamp 85 and track cable guides 102, are defined by narrower diameter 307 and greater diameter 309 in the opening of the channel through the assembly as best shown in FIG. 11D.

Plates 302, 304 are assembled by the insertion of a plurality of bolts 306 through a respective plurality of complementary bores 308 formed in the plates along the sides of the channels. Bolts 306 are special high resistance bolts to assure the proper tightening force, and are countersunk such that their heads are flush with the upper surface of clamping plates 304. Bolts 306 are retained by respective nuts 310. Flush mounting of the bolts prevents the possibility of the vehicle wheels colliding with one of them.

Clamping plates 304 each have an upper surface that is elevated at its center above the two center channels 304B to provide a greater cross-sectional area at the areas of greatest stress. The upper surfaces of plates 304 are further adapted for engagement by the wheels of the cable car.

The equalizing lock interfaces with the rail profile to assure a continuous running track. The rail profile must therefore accommodate the profile, i.e., shape of equalizing lock 300. It follows that the 45° expansion gap in the rail cannot be used at the rail's engagement with the equalizing lock.

It is therefore evident that the invention claimed herein includes many alternative and equally satisfactory embodiments without departing from the spirit or essential characteristics thereof. Those of ordinary skill in the art having the benefits of the teachings herein will quickly realize beneficial variations and modifications on the preferred embodiments disclosed herein such as that discussed in the above paragraph, all of which are intended to be within the scope of the invention. For instance, all cables in the preferred embodiment are locked-coil steel cables because of their high corrosion resistance, density, and moduli of elasticity as well as their lower sensitivity to bearing pressure. However, other types of cables may also be suitable in some embodiments. The preferred embodiments disclosed above must consequently be considered illustrative and not limiting of the scope of the invention.

what is claimed:

1. An elevated cableway system, comprising:

a catenary cable including at least two cable members;

a pair of track cables, each of said track cables including at least two cable members;

a plurality of hangers for suspending said track cables from said catenary cable; and a plurality of support pylons, at least one of said support pylons comprising a base pylon, an upper saddle for supporting said catenary cable, the upper saddle being movably mounted to the base pylon to articulate in response to forces applied by a vehicle traversing said track cables, said upper saddle having a maximum vertical dimension and a maximum horizontal dimension, said maximum vertical dimension being substantially larger than said maximum horizontal dimension, and a lower saddle mounted to the base pylon for supporting said track cables, the lower saddle including linkage means pivotally mounted to the base pylon beneath the upper saddle to accommodate the articulation of the upper saddle and transmit a portion of the forces applied to said track cables by the vehicle to said one pylon.

2. The elevated cableway system of claim 1, further comprising an assembly for joining said catenary cable to said track cables midway between said support pylons to equalize forces applied to said catenary cable with forces applied to said track cables.

3. The elevated cableway system of claim 1, wherein at least one of said hangers comprise a hanger member having upper and lower pieces and a joint that connects the upper and lower pieces for relative movement therebetween, the one hanger being suspended from said catenary cable by a first end of the hanger member, a hanger cross-tie pivotably mounted to the hanger member at a second end thereof distal to said catenary cable for supporting said track cables, and a track cable guide affixed to the hanger cross-tie.

4. The elevated cableway system of claim 1, wherein said upper saddle comprises an upright, a coupling mounted to and capping the upright for supporting said catenary cable, the coupling including a coupling base plate, at least two member plates connected to the coupling base plate and extending substantially perpendicular from the coupling base plate, the member plates being spaced apart, a pair of cable connectors each connected on one end to the member plates and connected on a second end to a section of said catenary cable, and pin means for joining the cable connector to the member plates such that the cable connector can pivot relative to the coupling, and a saddle base to which the upright is pivotably mounted for articulation, the saddle base including means for bearing the forces developed by the upright as it articulates.

5. The elevated cableway system of claim 1, wherein said lower saddle comprises a transverse pylon beam mounted transversely to the base pylon beneath the upper saddle, a transverse connecting frame connected to one end of the transverse pylon beam and extending downwardly therefrom for transmitting the forces to said one pylon, a main beam pivotally mounted at the center of its longitudinal axis to the transverse connecting frame for rotation in a first vertical plane, a pair of secondary beams each pivotally mounted at the center of its longitudinal axis to the main beam substantially at a respective end of the main beam for rotation in the first vertical plane, four tertiary beams each pivotally mounted at the center of its longitudinal axis to one of the respective secondary beams substantially at a respective end of the one secondary beam for rotation in the first vertical plane, eight suspension rods each pivotally mounted at one of its ends to one of the respective tertiary beams substantially at a respective end of the one tertiary beam for rotation in the first vertical plane, the other end of each suspension rod being pivotally connected to a suspension cross-tie at the center of the suspension cross-tie's longitudinal axis for rotation of the suspension cross-tie in the first vertical plane, the suspension cross-tie supporting said track cables, an equalizing beam of varying width across its length including superimposed plates of different lengths spanning the cross-ties to further equalize the forces applied by the vehicle across said track cable, and a lateral support stud carried by the transverse connecting frame for engagement with the equalizing beam.

6. The elevated cableway system of claim 2, wherein the force equalizing assembly comprises a force equalization plate having six parallel channels formed along the length of a surface thereof for accepting said catenary cable in the center channels and said track cables in the outer channels, the channels being shaped to approximate half of the respective cable circumferences except that the ends of the channels are flared outwardly, and a clamping plate having six parallel channels formed along the length of a first surface thereof for accepting said catenary cable in the center channels and said track cables in the outer channels, the channels being shaped to approximate the other half of the respective cable circumferences except that the ends of the channels are flared outwardly, the channeled clamping plate having a second surface opposite the first surface that is adapted for engagement by the wheels of the cable car, the second surface being elevated opposite the center channels to accommodate stresses imposed by the clamped cable assembly, the channeled surfaces of the force equalization plate and the clamping plate being complementary such that the plates are adaptable for bolting together through respective bores therein for frictionally locking said catenary and track cables within the respective channels to equalize the forces in said respective catenary and track cables, the respective flared ends of the channels in the assembled plates forming a frustoconical cavity in each end of the assembly about each of said respective catenary and track cables for reducing wear on the cables by the ends of the plates.

* * * * *